US008608499B2

(12) United States Patent
Umetsu et al.

(10) Patent No.: US 8,608,499 B2
(45) Date of Patent: Dec. 17, 2013

(54) CONNECTOR SYSTEM

(75) Inventors: Jun Umetsu, Hitachi (JP); Hideaki Takehara, Kitasaku-gun (JP); Kunihiro Fukuda, Tsukuba (JP); Sachio Suzuki, Hitachi (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 9 days.

(21) Appl. No.: 13/484,152

(22) Filed: May 30, 2012

(65) Prior Publication Data

US 2012/0322319 A1 Dec. 20, 2012

(30) Foreign Application Priority Data

Jun. 16, 2011 (JP) ..... 2011-134100

(51) Int. Cl.
*H01R 13/62* (2006.01)

(52) U.S. Cl.
USPC ..... 439/262; 439/372

(58) Field of Classification Search
USPC ..... 439/259, 262, 372, 157
See application file for complete search history.

(56) References Cited

U.S. PATENT DOCUMENTS

| | | | | |
|---|---|---|---|---|
| 7,892,038 | B1 | 2/2011 | Kataoka et al. | |
| 7,955,110 | B1 * | 6/2011 | Kataoka et al. | 439/284 |
| 8,105,099 | B2 * | 1/2012 | Suzuki et al. | 439/157 |
| 8,182,278 | B2 * | 5/2012 | Kataoka et al. | 439/266 |
| 8,308,508 | B2 * | 11/2012 | Suzuki et al. | 439/540.1 |

* cited by examiner

*Primary Examiner* — Hien Vu
(74) *Attorney, Agent, or Firm* — McGinn IP Law Group, PLLC

(57) ABSTRACT

A connector system includes a plurality of first connecting terminals, a plurality of second connecting terminals, a first housing, a second housing, a plurality of insulating members, a laminated structure formed by the plurality of first and second connecting terminals and the plurality of insulating members, a pressing mechanism including a rotary member rotatably supported on the first housing and configured to generate a pressing force to press the laminated structure in a lamination direction thereof, a rotation inhibiting mechanism configured to inhibit a rotation of the rotary member in a direction of generating the pressing force when the first housing is not fitted to the second housing, and a rotation-inhibition release mechanism configured to release the inhibition of the rotation of the rotary member by the rotation inhibiting mechanism so as to allow the rotation of the rotary member when the first housing is fitted to the second housing.

5 Claims, 15 Drawing Sheets

61FIRST PLATE PORTION
62 SECOND PLATE PORTION

CONNECTOR SYSTEM

The present application is based on Japanese patent application No. 2011-134100 filed on Jun. 16, 2011, the entire contents of which are incorporated herein by reference.

BACKGROUND OF THE INVENTION

1. Field of the Invention

The invention relates to a connector system with a pressing mechanism that is operable to press both plural connecting terminals held by a first housing and plural connecting terminals held by a second housing after the first and second housings are fitted to each other.

2. Description of the Related Art

A connector conventionally used is provided on, e.g., a current supply path for supplying an electric current to an electric motor as a drive source of an electric vehicle so as to be removable between power harnesses or between a power harness and a motor or an inverter. This type of connector is known, in which a first connector portion is coupled to a second connector portion and connecting terminals of the respective two connector portions can be then pressed and brought into contact with each other (see, e.g., U.S. Pat. No. 7,892,038).

The connector described in U.S. Pat. No. 7,892,038 is provided with a first connector portion having a first housing for accommodating plural first connecting terminals and a second connector portion having a second housing for accommodating plural second connecting terminals, and is configured that the first and second connecting terminals are alternately arranged in a laminated manner when the first connector portion is fitted to the second connector portion. This connector is further provided with plural insulating members fixed to surfaces of the plural first connecting terminals on one side and a connecting member for pressing the plural insulating members to collectively fix and electrically connect the plural first connecting terminals to the plural second connecting terminals at each contact point.

The connecting member is composed of an externally operable head, a shaft connected to the head and an insulation layer for covering the outer periphery of the shaft. The shaft penetrates the plural first connecting terminals, the plural second connecting terminals and the plural insulating members, and a screwing portion to be screwed into the first housing is formed at a tip of the shaft. The connecting member is configured such that the screwing portion is screwed into the first housing by rotationally operating the head and the head then presses the plural first connecting terminals and the plural second connecting terminals via an elastic member.

SUMMARY OF THE INVENTION

However, if the connecting member is turned before the first housing is fitted to the second housing, the first and second connecting terminals may scrape against each other in the pressed state when the two housings are fitted. Therefore, a problem may arise that plating formed on the surface of the connecting terminals is removed.

Accordingly, it is an object of the invention to provide a connector system that can prevent an operation to press the first and second connecting terminals before fitting the first housing to the second housing.

(1) According to one embodiment of the invention, a connector system comprises:

a plurality of first connecting terminals;

a plurality of second connecting terminals each connected to the plurality of first connecting terminals;

a first housing for holding the plurality of first connecting terminals;

a second housing for holding the plurality of second connecting terminals;

a plurality of insulating members that are interposed between contact points of the plurality of first connecting terminals with the plurality of second connecting terminals when the first terminal housing is fitted to the second terminal housing;

a laminated structure that is formed by the plurality of first connecting terminals, the plurality of second connecting terminals and the plurality of insulating members when the first terminal housing is fitted to the second terminal housing;

a pressing mechanism comprising a rotary member rotatably supported on the first housing and configured to generate a pressing force to press the laminated structure composed of the plurality of first connecting terminals, the plurality of second connecting terminals and the plurality of insulating members in a lamination direction thereof;

a rotation inhibiting mechanism configured to inhibit a rotation of the rotary member in a direction of generating the pressing force when the first housing is not fitted to the second housing; and a rotation-inhibition release mechanism configured to release the inhibition of the rotation of the rotary member by the rotation inhibiting mechanism so as to allow the rotation of the rotary member when the first housing is fitted to the second housing.

In the above embodiment (1) of the invention, the following modifications and changes can be made.

(i) The rotation inhibiting mechanism comprises a locking piece on a side of the first housing and supported by an elastically deformable elastic support to lock the rotary member to inhibit a rotation thereof, wherein the rotation-inhibition release mechanism comprises a protrusion on a side of the second housing, and wherein the protrusion is configured to displace the locking piece in a direction of unlocking the rotary member from the locking piece when the first housing is fitted to the second housing.

(ii) The rotary member comprises a recessed portion configured to open outwardly in a radial direction thereof and is engaged with the locking piece at a rotational position where the pressing force is not generated, wherein the protrusion is provided inside a housing portion of the second housing and formed to house at least a portion of the first housing, and wherein the rotation-inhibition release mechanism is configured to displace the locking piece outwardly in a radial direction of the rotary member when the protrusion contacts with an inclined surface that is formed on the locking piece so as to be inclined with respect to a direction of fitting the first housing to the second housing.

(iii) The rotary member comprises, at a rotational center thereof, a tool receiving portion for receiving a tip of a tool used for turning the rotary member, and wherein the housing portion of the second hosing comprises a through-hole formed at a position corresponding to the tool receiving portion of the rotary member when the first housing is completely fitted to the second housing.

(iv) The connector system further comprises:

a lid member slidably provided on the first housing so as to cover at least a portion of the rotary member, wherein the lid member comprises a tool insertion hole for inserting a tool used for turning the rotary member and a protruding portion protruding toward the rotary member, and wherein the lid member is configured to allow the tool insertion hole to move between a first position corresponding to the tool receiving portion of the rotary member and a second position allowing rotation of the rotary member to be inhibited by the protruding portion.

(v) The lid member comprises a lid portion, the locking piece and the elastic support, the lid portion covering at least a portion of the rotary member and having the tool insertion hole and the protruding portion formed thereon, and wherein the lid portion, the locking piece and the elastic support are integrally formed.

POINTS OF THE INVENTION

According to one embodiment of the invention, a connector system is constructed such that before the first housing is fitted to the second housing, the rotation of a rotary member for pressing the first and second connecting terminals is inhibited by the engagement of a locking piece of a lid member with a first recessed portion of the rotary member. Thereby, even if an operator tries to turn the rotary member, e.g., by mistake in procedure, the turning operation can be prevented when the first housing is not fitted to the second housing. Accordingly, a pressing mechanism operated by the rotary member is prevented from being operated before the first housing is fitted to the second housing. Thus, the first and second connecting terminals can be avoided from scraping against each other in the pressed state when the first housing is erroneously fitted to the second hosing.

BRIEF DESCRIPTION OF THE DRAWINGS

Next, the present invention will be explained in more detail in conjunction with appended drawings, wherein:

FIGS. 5A and 5B show a structure of a first element of the male housing, wherein FIG. 5A is a front view and FIG. 5B is a side view;

FIGS. 6A to 6C show a structure of the lid member, wherein FIG. 6A is a perspective view, FIG. 6B is a back view and FIG. 6C is a side view;

FIGS. 7A to 7D show a state that the first element of the male housing is assembled with the lid member, wherein FIG. 7A is a front view showing a state that the lid member is located at a first position, FIG. 7B is a side view of the state shown in FIG. 7A, FIG. 7C is a front view showing a state that the lid member is located at a second position and FIG. 7D is a side view of the state shown in FIG. 7C;

FIGS. 8A to 8C show a structure of a first element of the female housing, wherein FIG. 8A is a perspective view, FIG. 8B is a view along an arrow A in FIG. 8A and FIG. 8C is a view along an arrow B in FIG. 8A;

FIGS. 9A to 9D show structures and movement of a rotary member and a cam ring, wherein FIG. 9A is a perspective view showing the rotary member and the cam ring and FIGS. 9B to 9D are side views showing an operating state thereof;

FIGS. 10A and 10B are explanatory diagrams illustrating a structure of a rotation inhibiting mechanism, wherein FIG. 10A is a front view showing the connector system with the first housing of the female connector partly broken away and FIG. 10B is a partial enlarged view of FIG. 10A;

FIGS. 11A to 11C are explanatory diagrams illustrating a structure and a function of a rotation-inhibition release mechanism, wherein FIG. 11A is a front view showing the connector system with the first housing of the female connector partly broken away, FIG. 11B is a partial enlarged view of FIG. 11A and FIG. 11C is a state diagram illustrating that a protrusion is in contact with an inclined surface of a folded-back portion.

DETAILED DESCRIPTION OF THE PREFERRED EMBODIMENTS

Embodiment

Figure 1A:
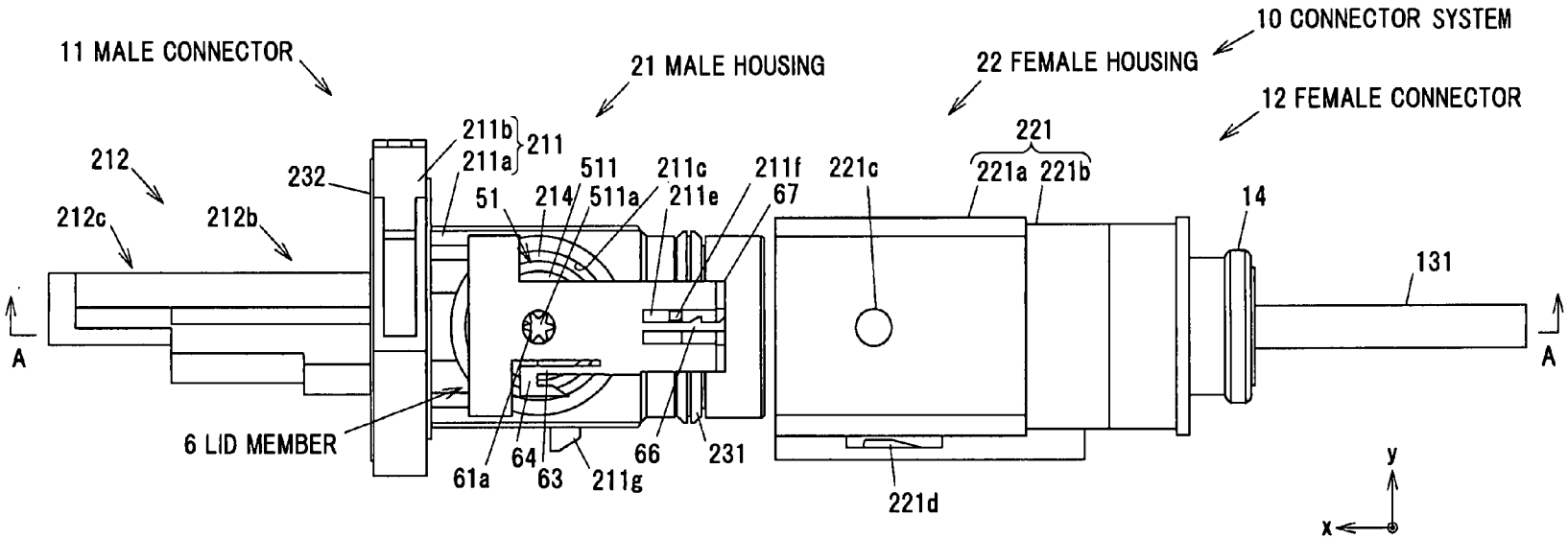
FIG. 1A is a front view showing a configuration example of a connector system in an embodiment of the present invention.
Figure 1B:
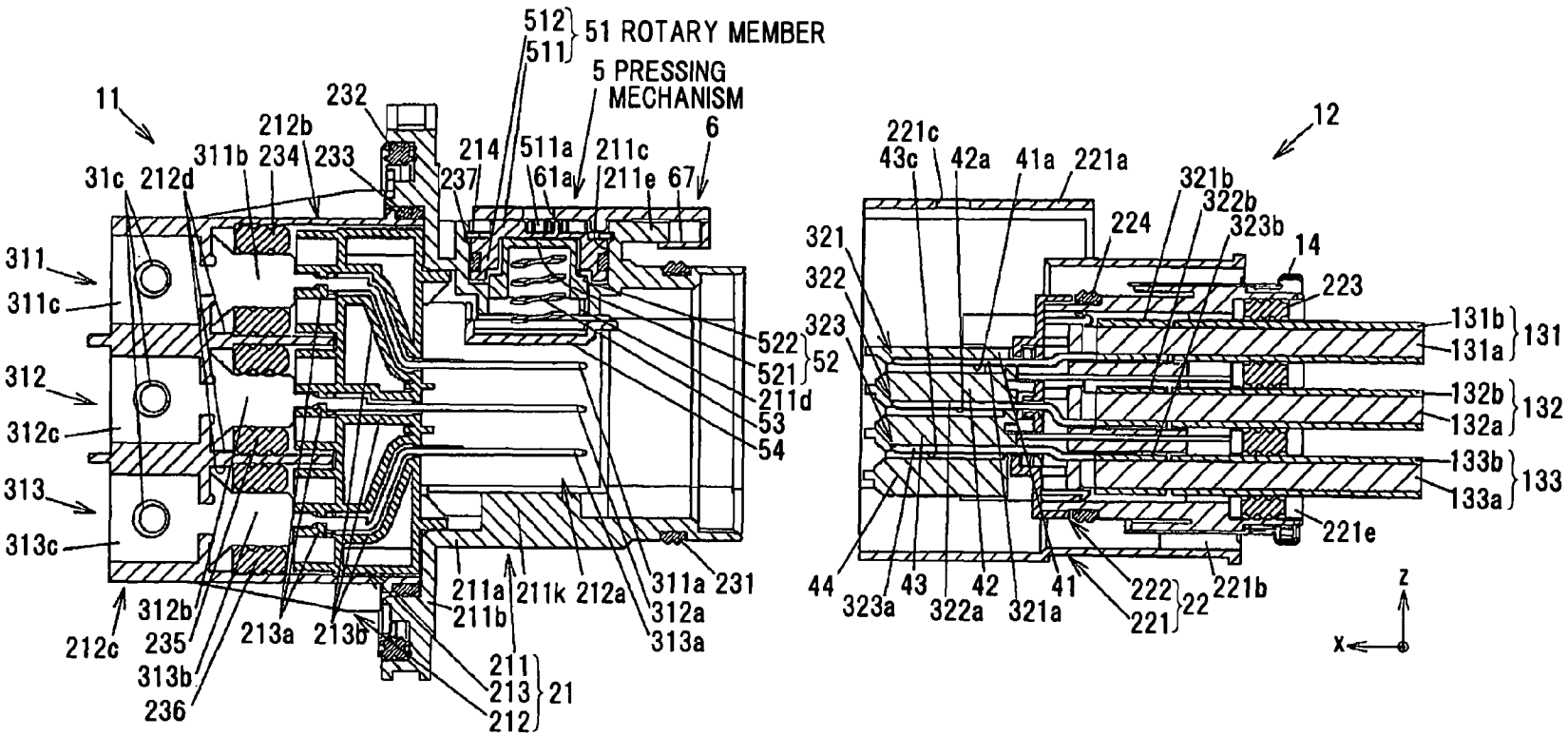
FIG. 1B is a cross sectional view taken along a line A-A in FIG. 1A.

FIG. 1A is a front view showing a configuration example of a connector system 10 in an embodiment of the invention and FIG. 1B is a cross sectional view taken along a line A-A in FIG. 1A.

The connector system 10 has a male connector 11 and a female connector 12. The male connector 11 is coupled to the female connector 12 by fitting a male housing 21 of the male connector 11 to a female housing 22 of the female connector 12. In the present embodiment, the male housing 21 is fitted to the female housing 22 so that the male housing 21 is partially housed therein.

As shown in FIG. 1B, three wires 131, 132 and 133 for supplying an electric current to, e.g., an electric motor as a drive source of a vehicle are connected to the female connector 12. The electric motor is, e.g., a three-phase AC motor, and the three wires 131, 132 and 133 supply currents in respective phases to the three-phase AC motor. The vehicle mounting such an electric motor includes, e.g., an electric vehicle using an electric motor as a unique drive source and a so-called hybrid car in which an electric motor and an internal-combustion engine are used together as a drive source.

Male Connector 11

The male connector 11 has male connecting terminals 311, 312 and 313 as plural first connecting terminals and the male housing 21 as a first housing for holding the male connecting terminals 311, 312 and 313.

The male connecting terminals 311, 312 and 313 are each formed of a base material made of, e.g., copper alloy of which surface is plated with tin, and end portions thereof on one side are formed as plate-like contact pieces 311*a*, 312*a* and 313*a*.

In addition, end portions on another side are formed as washer pieces 311*c*, 312*c* and 313*c* which constitute a below-described terminal block 212*c*. The contact pieces 311*a*, 312*a* and 313*a* are integrally connected to the washer pieces 311*c*, 312*c* and 313*c* by coupling portion 311*b*, 312*b* and 313*b*. A difference in plane orientation between the contact pieces 311*a*, 312*a* and 313*a* and the washer pieces 311*c*, 312*c* and 313*c* is each 90°, and the coupling portion 311*b*, 312*b* and 313*b* serve as a plane changing portion for changing orientation of the plane.

The male housing 21 is composed of a first element 211 made of metal such as aluminum, and a second element 212 and a third element 213 which are made of resin and held by the first element 211. For the resin, it is possible to use, e.g., an insulating resin such as PBT (polybutylene terephthalate), PPS (polyphenylene sulfide) and PA (polyamide). Alternatively, the first element 211 may be formed of resin as are the second element 212 and the third element 213.

The first element 211 integrally includes a cylinder portion 211*a* in a cylindrical shape for housing the contact pieces 311*a*, 312*a* and 313*a* of the male connecting terminals 311, 312 and 313 and a flange portion 211*b* having a through-hole (shot shown) for fixing the male housing 21 to an object to be fixed such as a case of a device. An annular sealing member 231 is held on an outer peripheral surface of the cylinder portion 211*a*. Meanwhile, an annular sealing member 232 is held on a side surface of the flange portion 211*b*.

A holding hole 211*c* is formed on the cylinder portion 211*a* so as to penetrate from inside to outside. A below-described rotary member 51 is rotatably held in the holding hole 211*c*. A protrusion 211*d* which protrudes toward the center of the holding hole 211*c* is formed on the inner surface of the holding hole 211*c*. Meanwhile, inside the cylinder portion 211*a*, a raised portion 211*k* is formed opposite to the holding hole 211*c*. The raised portion 211*k* is formed so as to protrude toward the holding hole 211*c*.

In addition, a support protrusion 211*e* is formed on the outer periphery of the cylinder portion 211*a* in the vicinity of the holding hole 211*c*. The support protrusion 211*e* is formed at a portion of the holding hole 211*c* opposite to the flange portion 211*b* so as to protrude toward the side opposite to the flange portion 211*b* along a direction of fitting the male housing 21 to the female housing 22 (an x-axis direction shown in FIGS. 1A and 1B).

As shown in FIG. 1A, a locking protrusion 211*f* for locking a below-described lid member 6 is provided on the support protrusion 211*e*. The locking protrusion 211*f* is integrally formed with the support protrusion 211*e* so as to protrude outward from the cylinder portion 211*a*.

Furthermore, a fitting protrusion 211*g* for lance-fit to the female housing 22 of the female connector 12 is provided on the cylinder portion 211*a*.

The second element 212 is partially housed in the cylinder portion 211*a* of the first element 211 and is held by the first element 211. A sealing member 233 is arranged between the second element 212 and the flange portion 211*b* of the first element 211.

The second element 212 integrally includes a support 212*a* housed in the cylinder portion 211*a* of the first element 211, a terminal block 212*c* formed at an end portion protruding from the first element 211 and a holding portion 212*b* formed between the support 212*a* and the terminal block 212*c* to hold the third element 213.

The support 212*a* supports, movably in a pressing direction, an output member 54 which outputs a pressing force of a below-described pressing mechanism 5. Three insertion holes 212*d* for inserting the coupling portions 311*b*, 312*b* and 313*b* of the male connecting terminals 311, 312 and 313 are formed in the holding portion 212*b*. Inside the three insertion holes 212*d*, three sealing members 234 to 236 are each arranged to seal between the second element 212 and the coupling portions 311*b*, 312*b*, 313*b* of the male connecting terminals 311, 312, 313.

The washer pieces 311*c*, 312*c* and 313*c* of the male connecting terminals 311, 312 and 313 are held in an array on the terminal block 212*c*. Three through-holes 31*c* for inserting a bolt to fix to terminals of a connection target are formed on the washer pieces 311*c*, 312*c*, 313*c* and the terminal block 212*c*.

The third element 213 is held by the holding portion 212*b* of the second element 212. The third element 213 holds the coupling portions 311*b*, 312*b* and 313*b* of the male connecting terminals 311, 312 and 313 so that the contact pieces 311*a*, 312*a* and 313*a* are arranged in parallel at equal intervals.

In more detail, the third element 213 has three protruding portions 213*a* formed each corresponding to the male connecting terminals 311, 312 and 313, and guides 213*b* formed on the contact pieces 311*a*, 312*a* and 313*a* side of the protruding portion 213*a* to guide the coupling portions 311*b*, 312*b* and 313*b*. In addition, the third element 213 supports the coupling portions 311*b*, 312*b* and 313*b* of the male connecting terminals 311, 312 and 313 by the protruding portions 213*a*.

The male connector 11 is also provided with a pressing mechanism 5 composed of a rotary member 51 rotatably supported by the first element 211, a cam ring 52 moving back and forth in a rotation axis direction of the rotary member 51 due to a camming action caused by rotation of the rotary member 51, a coil spring 53 in contact with the cam ring 52 at one end and an output member 54 in contact with another end of the coil spring 53.

The male connector 11 is further provided with a lid member 6 provided on the male housing 21 so as to be slidable with respect to the first element 211 and to cover at least a portion of the rotary member 51. The lid member 6 is slidable with respect to the first element 211 along the direction of fitting the male housing 21 to the female housing 22. In addition, a tool insertion hole 61*a* is formed on the lid member 6 at a position corresponding to a tool receiving portion 511*a* (described later) formed on the rotary member 51. The detail of the lid member 6 will be described later.

Female Connector 12

The female connector 12 has female connecting terminals 321, 322 and 323 as plural second connecting terminals and the female housing 22 as a second housing for holding the female connecting terminals 321, 322 and 323. The wires 131, 132 and 133 are electrically connected to the female connecting terminals 321, 322 and 323. The wires 131, 132 and 133 are each composed of cores 131*a*, 132*a* and 133*a* formed of conductive metal and insulating films 131*b*, 132*b* and 133*b* covering thereon except the tip portions. The cores 131*a*, 132*a* and 133*a* have a cross-sectional area of, e.g., 10 to 40 $mm^2$.

The female connecting terminals 321, 322 and 323 are each formed of a base material made of, e.g., copper alloy of which surface is plated with tin, and end portions thereof on one side are formed as plate-like contact pieces 321*a*, 322*a* and 323*a*. In addition, end portions on another side are formed as caulking portion 321*b*, 322*b* and 323*b* for caulking and fixing the tip portions of the cores 131*a*, 132*a* and 133*a* of the wires 131, 132 and 133.

The female housing 22 is composed of a first element 221 and a second element 222 held by the first element 221. As a material of the first element 221 and the second element 222, it is possible to use the same insulating resin as the second and third elements of the male housing 21.

The first element 221 integrally includes a housing portion 221*a* for housing the contact pieces 321*a*, 322*a* and 323*a* of the female connecting terminals 321, 322 and 323 and a holding portion 221*b* for holding the caulking portion 321*b*, 322*b* and 323*b* of the female connecting terminals 321, 322 and 323.

A through-hole 221*c* is formed on the housing portion 221*a* at a position which corresponds to the tool receiving portion 511*a* of the rotary member 51 in a state that the male housing 21 is fitted to the female housing 22. In addition, on the outer surface of the housing portion 221*a*, a fitting recess 221*d* for lance-fit to the fitting protrusion 211*g* provided on the first element 211 of the male connector 11 is formed as shown in FIG. 1A.

An outer periphery of the holding portion 221*b* is partially covered by a metal cover member 14. Meanwhile, in an opening 221*e* formed on the holding portion 221*b* to insert the wires 131, 132 and 133, a sealing member 223 for sealing between the wires 131, 132 and 133 and the inner surface of the opening 221*e* is arranged. In addition, a sealing member 224 for sealing between the holding portion 221*b* and the first element 211 of the male connector 11 is arranged on the outer surface of the holding portion 221*b*.

The second element 222 holds a first insulating member 41, a second insulating member 42, a third insulating member 43 and a fourth insulating member 44 which are formed of an insulating material having electrical insulating properties. As the insulating material, it is possible to use, e.g., a resin material such as PPS (polyphenylene sulfide), PPA (polyphthalamide), PA (polyamide), PBT (polybutylene terephthalate) or epoxy-based resins.

The contact piece 321*a* is interposed between the first insulating member 41 and the second insulating member 42, the contact piece 322*a* is interposed between the second insulating member 42 and the third insulating member 43 and the contact piece 323*a* is interposed between the third insulating member 43 and the fourth insulating member 44.

In addition, a recessed portion 41*a* is formed on the first insulating member 41 and the contact piece 321*a* is held by the recessed portion 41*a*. Likewise, recessed portions 42*a* and 43*a* are each formed on the second insulating member 42 and the third insulating member 43, and the contact pieces 322*a* and 323*a* are held by the recessed portions 42*a* and 43*a*.

The second element 222 aligns and holds the first insulating member 41, the second insulating member 42, the third insulating member 43 and the fourth insulating member 44 in a direction perpendicular to the contact pieces 321*a*, 322*a* and 323*a* (in a z-axis direction) so that the first to fourth insulating members 41 to 44 are translatable within a predetermined range.

Figure 2A:
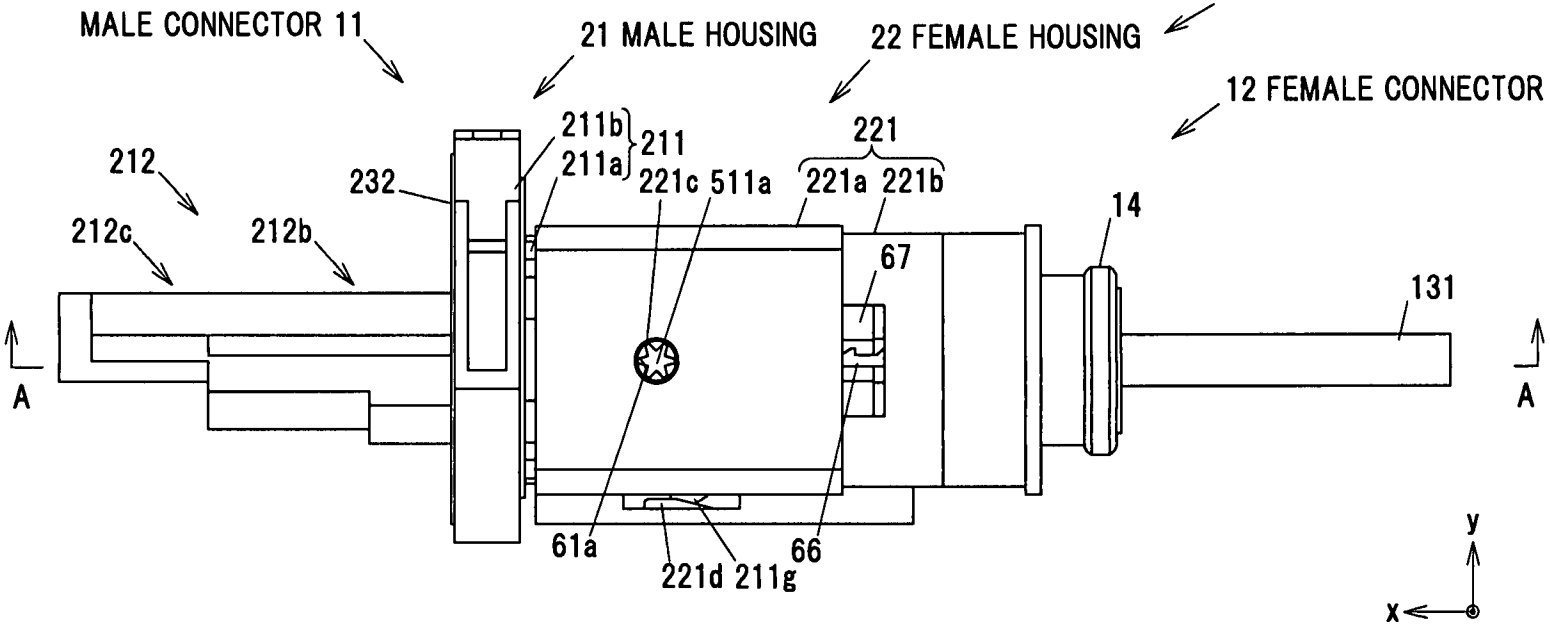
FIG. 2A is a front view showing a configuration example of the connector system in a state that a male housing is fitted to a female housing.
Figure 2B:
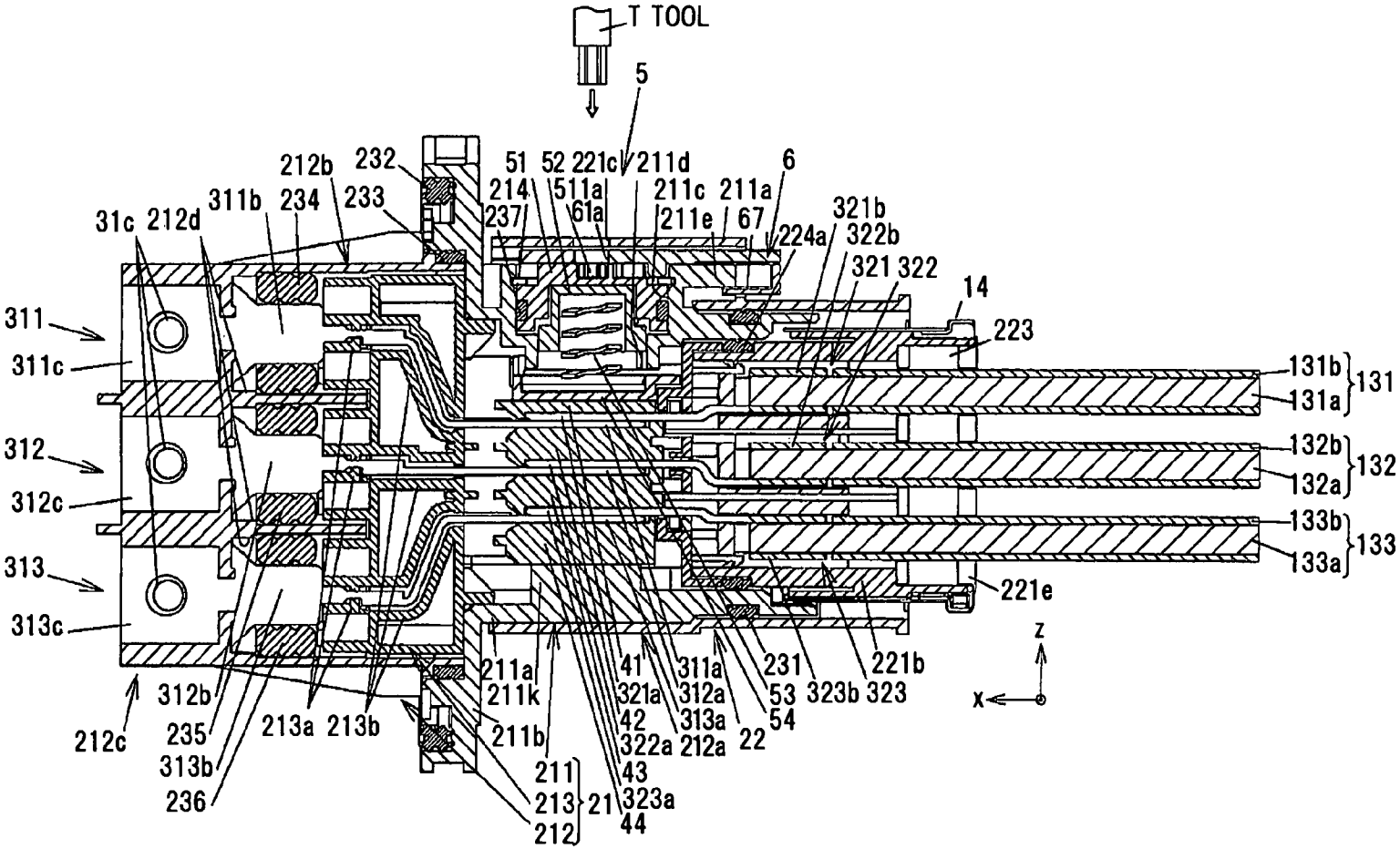
FIG. 2B is a cross sectional view taken along a line A-A in FIG. 2A.

FIG. 2A is a front view showing a configuration example of the connector system 10 in a state that the male housing 21 is fitted to the female housing 22 and the male connector 11 is thereby coupled to the female connector 12. FIG. 2B is a cross sectional view taken along a line A-A in FIG. 2A.

FIGS. 2A and 2B show a fitted state in which the male housing 21 and the female housing 22 are relatively moved in the fitting direction (the x-axis direction) so that the cylinder portion 211*a* of the first element 211 of the male connector 11 is housed together with the lid member 6 in the housing portion 221*a* of the first element 221 of the female connector 12 and the male housing 21 is completely fitted to the female housing 22.

In the fitted state, the through-hole 221*c* formed on the housing portion 221*a* of the first element 221 of the female housing 22 is located at a position corresponding to the tool receiving portion 511*a* of the rotary member 51 as well as to the tool insertion hole 61*a* of the lid member 6, and it is thus possible to fit a tool T into the tool receiving portion 511*a* from the outside through the through-hole 221*c* and the tool insertion hole 61*a*.

In addition, in the fitted state, the contact piece 311*a* of the male connecting terminal 311 is sandwiched between the contact piece 321*a* of the female connecting terminal 321 held by the first insulating member 41 and the second insulating member 42. Furthermore, the contact piece 312*a* of the male connecting terminal 312 is sandwiched between the contact piece 322*a* of the female connecting terminal 322 held by the second insulating member 42 and the third insulating member 43. Still further, the contact piece 313*a* of the male connecting terminal 313 is sandwiched between the contact piece 323*a* of the female connecting terminal 323 held by the third insulating member 43 and the fourth insulating member 44.

Accordingly, in the fitted state of the male housing 21 and the female housing 22, the first insulating member 41, the contact piece 321*a* of the female connecting terminal 321, the contact piece 311*a* of the male connecting terminal 311, the second insulating member 42, the contact piece 322*a* of the female connecting terminal 322, the contact piece 312*a* of the male connecting terminal 312, the third insulating member 43, the contact piece 323*a* of the female connecting terminal 323, the contact piece 313*a* of the male connecting terminal 313 and the fourth insulating member 44 are laminated in this order in a lamination direction (the z-axis direction) and form a laminated structure.

In other words, the first insulating member 41, the second insulating member 42, the third insulating member 43 and the fourth insulating member 44 sandwich respective contact points between the male connecting terminal 311 and the female connecting terminal 321, between the male connecting terminal 312 and the female connecting terminal 322 and between the male connecting terminal 313 and the female connecting terminal 323 when the male housing 21 is fitted to the female housing 22.

Meanwhile, the pressing mechanism 5 is not generating a pressing force in the state shown in FIGS. 2A and 2B, and the male connecting terminals 311, 312, 313 and the female connecting terminals 321, 322, 323 are not pressed in a direction of coming into contact with each other even though the male connecting terminals 311, 312, 313 and the female connecting terminals 321, 322, 323 may be in contact with each other due to elasticity or self-weight, etc., thereof.

In the connector system 10, the male connector 11 is coupled to the female connector 12, the rotary member 51 is turned so that the pressing mechanism 5 generates a pressing force to press the male connecting terminals 311, 312, 313 and the female connecting terminals 321, 322, 323 in the lamination direction and the lid member 6 is then slid, thereby completing a working process of connecting the male connector 11 to the female connector 12.

Figure 3:
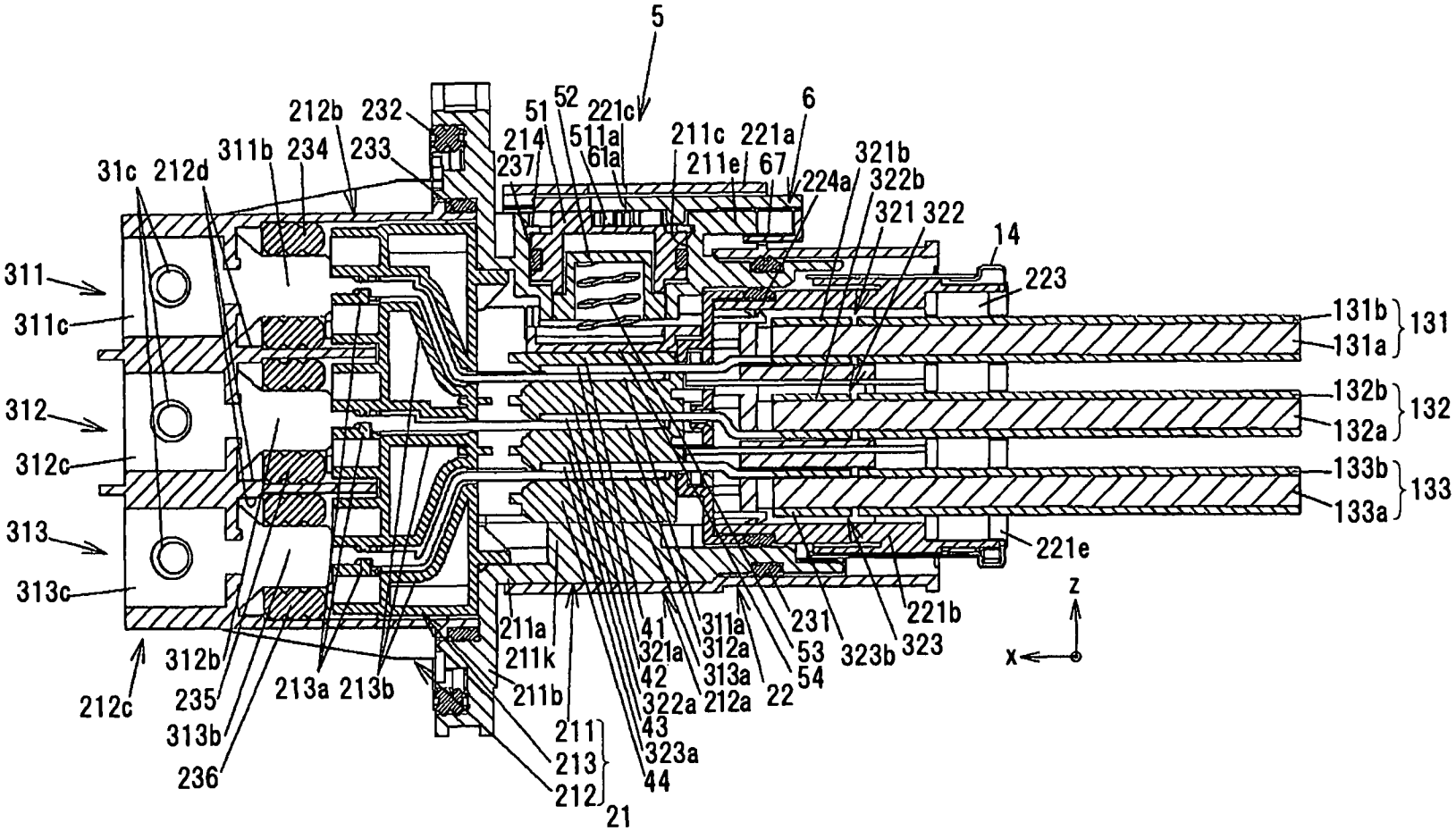
FIG. 3 is a cross sectional view showing a configuration example of the connector system in a state that a pressing mechanism is operated.

FIG. 3 shows a state that the cam ring 52 is moved in a direction separating from the rotary member 51 in accordance with rotation of the rotary member 51. In this state, the pressing mechanism 5 is generating a pressing force to press, in the lamination direction, the laminated structure composed of the male connecting terminals 311 to 313, the female connecting terminals 321 to 323 and the first to fourth insulating members 41 to 44. The male connecting terminals 311 to 313 and the female connecting terminals 321 to 323 are in contact with each other at each contact point due to a load applied in a direction of coming into contact with each other by pressing force.

Figure 4A:
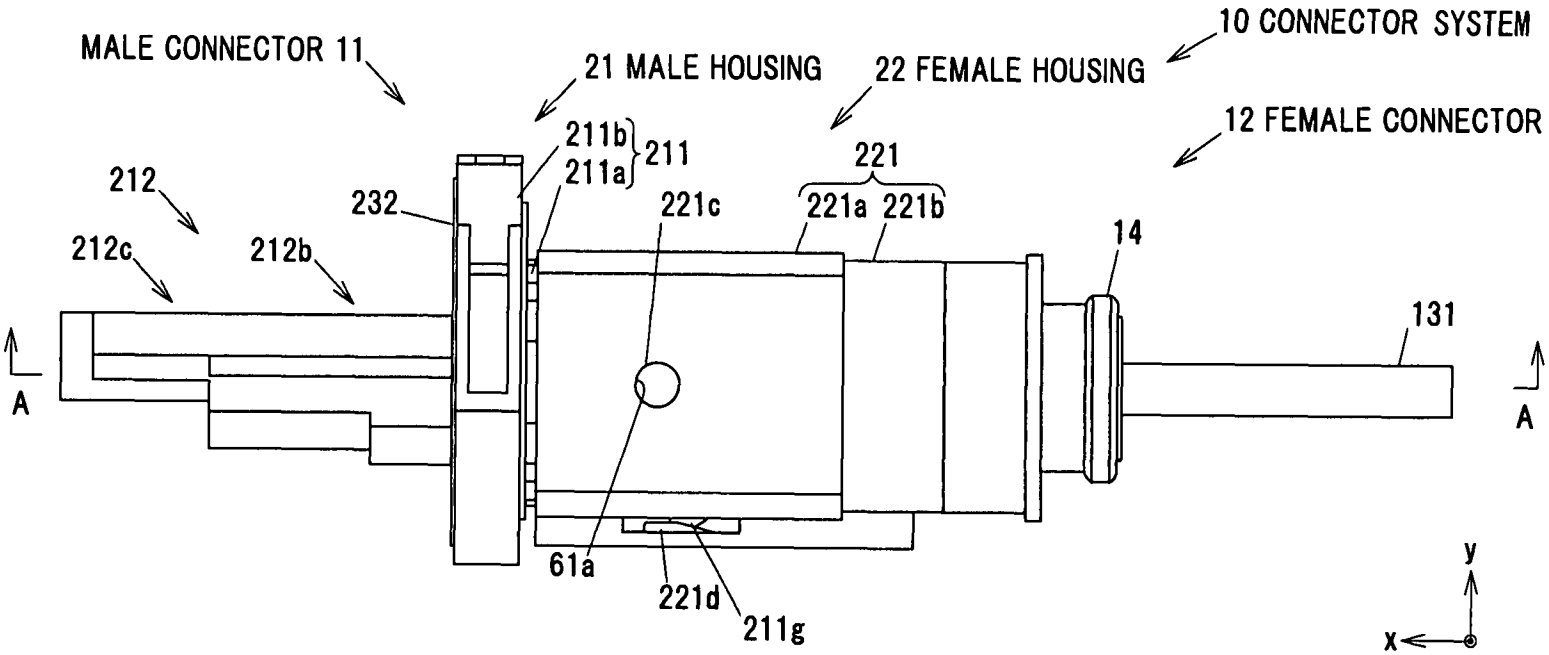
FIG. 4A is a front view showing a configuration example of the connector system in a state that a lid member is slid.
Figure 4B:
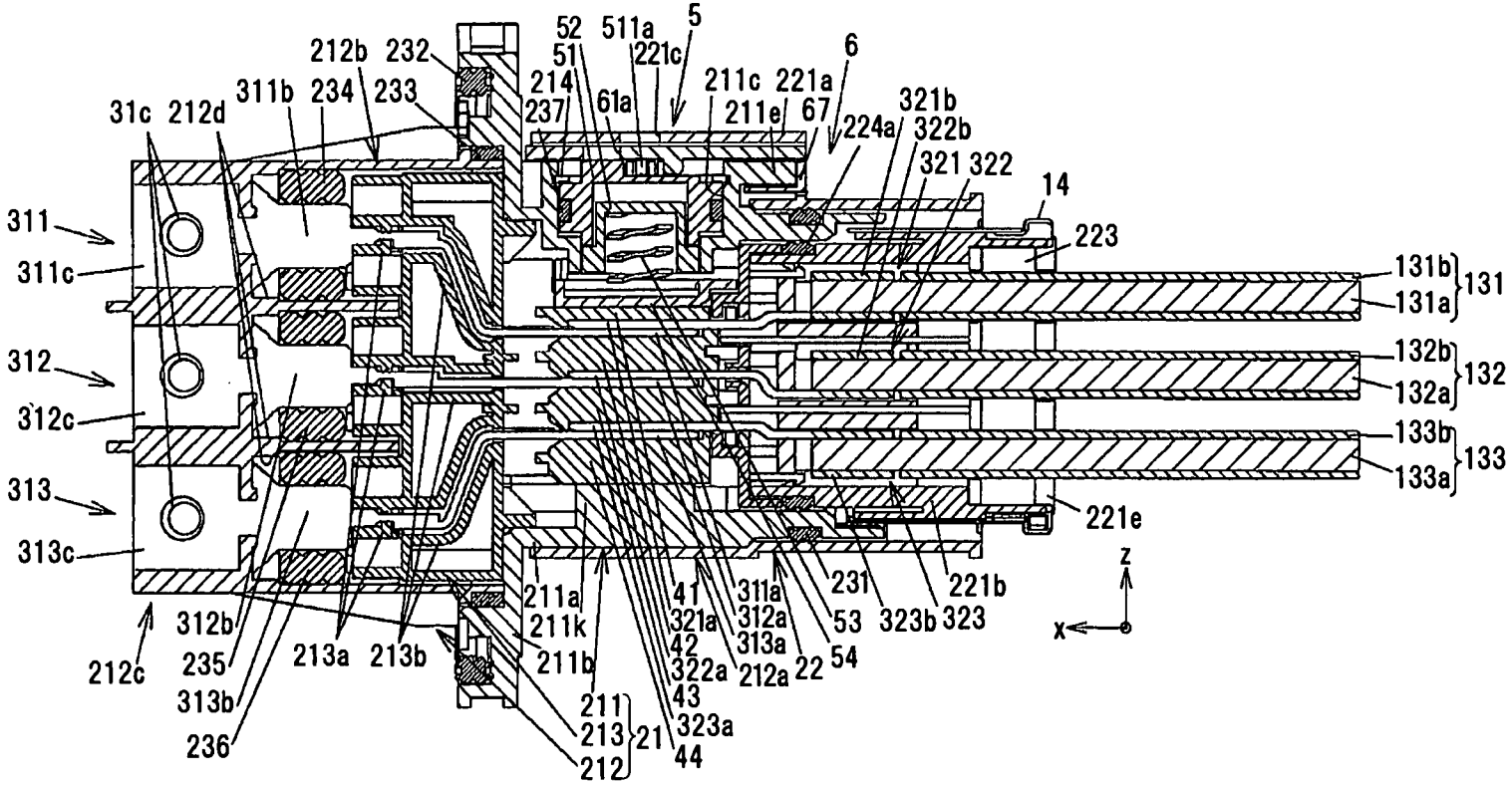
FIG. 4B is a cross sectional view taken along a line A-A in FIG. 4A.

FIG. 4A is a front view showing a state that the lid member 6 is further slidably moved from the state shown in FIG. 3. FIG. 4B is a cross sectional view taken along a line A-A in FIG. 4A. In this state, the rotation of the rotary member 51 is inhibited by the lid member 6 and the through-hole 221*c* of the first element 221 of the female housing 22 is blocked by the lid member 6, hence, it is not possible to turn the rotary member 51 from the outside. In addition, although a portion of a supported portion 67 of the lid member 6 is exposed from the female connector 12 in the state shown in FIG. 3, the supported portion 67 of the lid member 6 is housed in the female connector 12 by moving the lid member 6 in a sliding manner.

First Element 211 of Male Housing 21

Figure 5B:
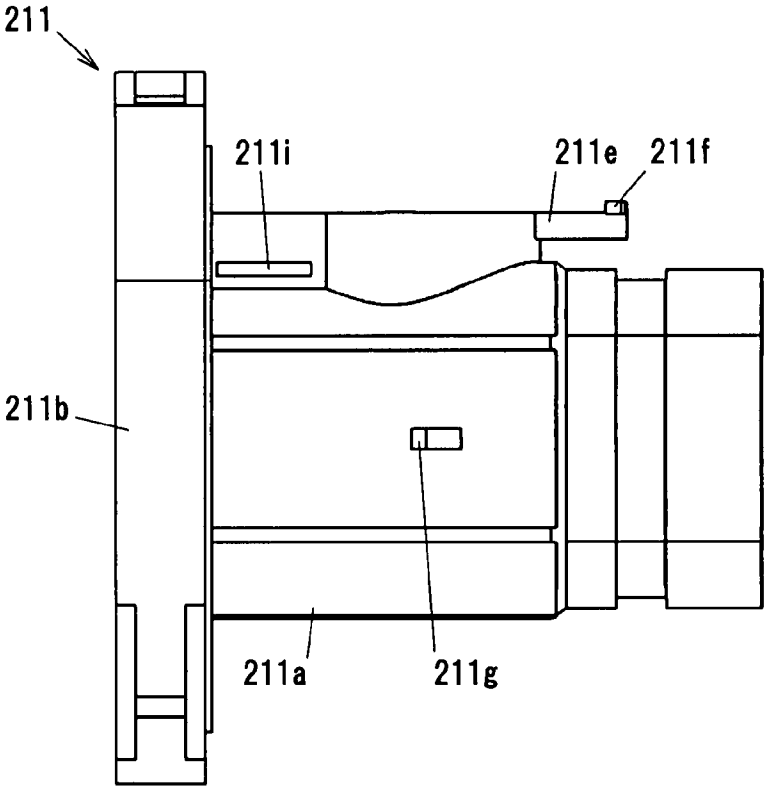
Figure 5A:
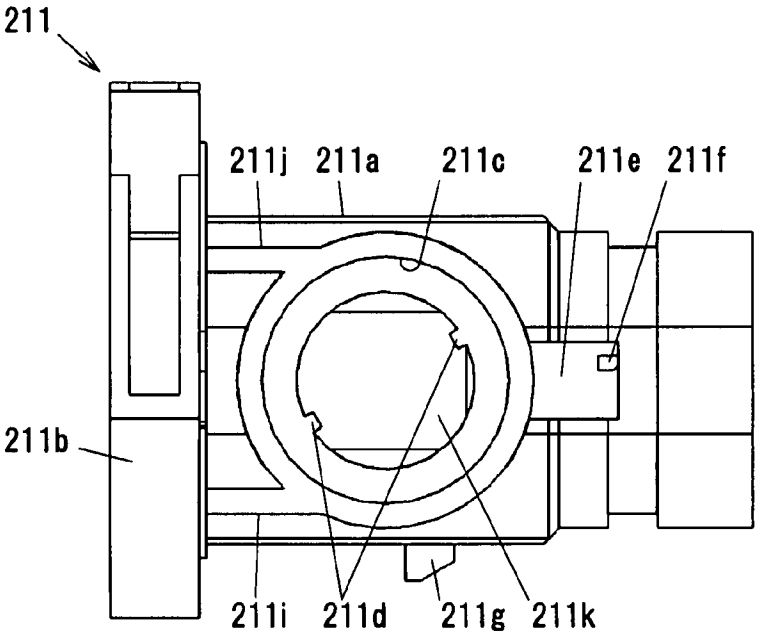

FIGS. 5A and 5B show a structure of the first element 211 of the male housing 21, wherein FIG. 5A is a front view and FIG. 5B is a side view.

On the first element 211, a pair of guide grooves 211*i* and 211*j* extending along the direction of fitting the male housing 21 to the female housing 22 is formed at a portion adjacent to the flange portion 211*b* on the holding hole 211*c* side. The guide grooves 211*i* and 211*j* are parallel to each other and are formed at positions where respective extended lines in an extending direction thereof sandwich the holding hole 211*c* and the support protrusion 211*e*.

Meanwhile, the raised portion 211*k* of the first element 211 is formed to face the holding hole 211*c* within a region including at least positions corresponding to each contact point between the male connecting terminals 311, 312, 313 and the female connecting terminals 321, 322, 323 to receive a pressing force from the pressing mechanism 5. The front end surface of the raised portion 211*k* is a flat surface parallel to the direction of fitting the male housing 21 to the female housing 22 and faces the fourth insulating member 44 in a state that the male connector 11 is coupled to the female connector 12.

Lid Member 6

Figure 6A:
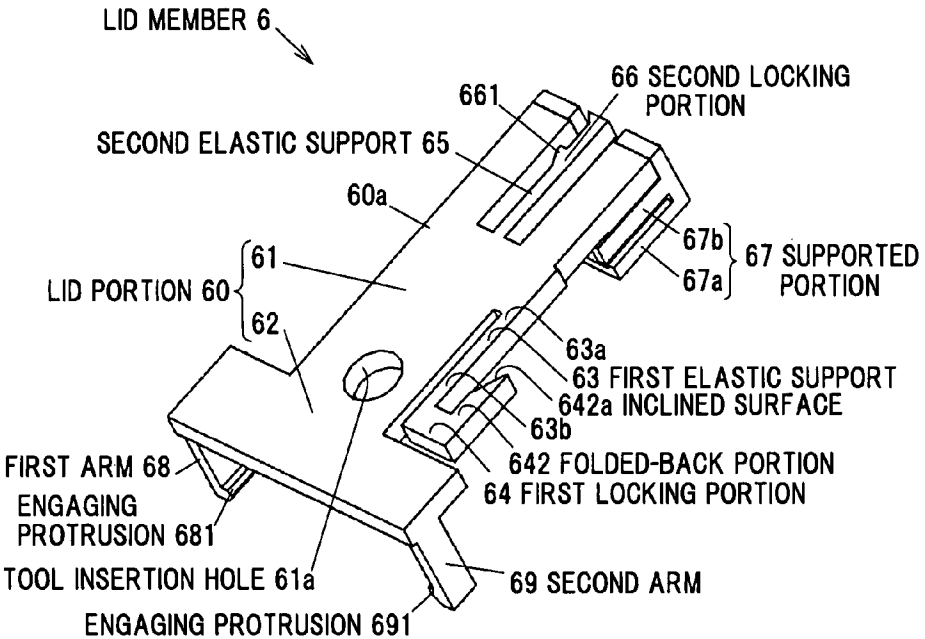
Figure 6B:
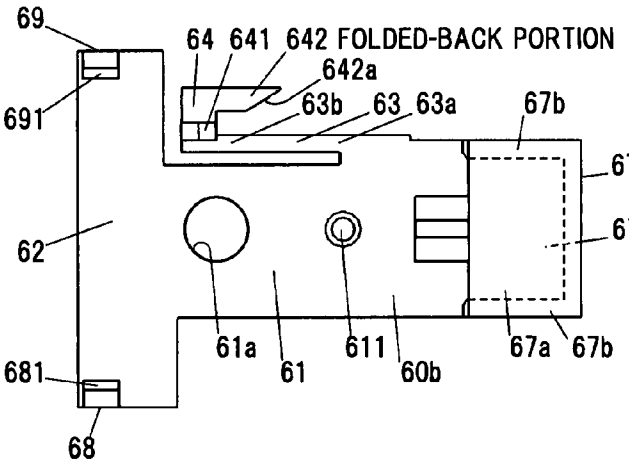
Figure 6C:
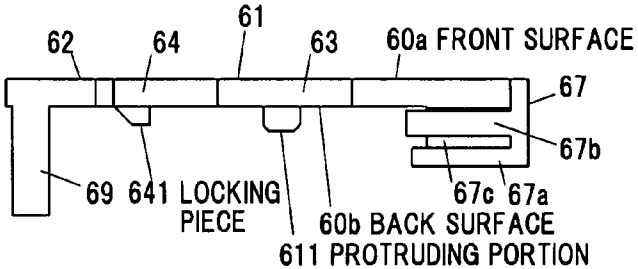

FIGS. 6A to 6C show a structure of the lid member 6, wherein FIG. 6A is a perspective view, FIG. 6B is a back view and FIG. 6C is a side view.

The lid member 6 is formed of, e.g., an insulating resin such as PBT (polybutylene terephthalate), PPS (polyphenylene sulfide) or PA (polyamide), and integrally includes a first plate portion 61 and a second plate portion 62. The first plate portion 61 has a thickness in the lamination direction of the laminated structure (in the z-axis direction in FIG. 1B) and is formed so that the longitudinal direction thereof coincides with the direction of fitting the male housing 21 to the female housing 22. The second plate portion 62 is formed so as to extend in a direction orthogonal to the longitudinal direction of the first plate portion 61 and has the same thickness as the first plate portion 61 (a thickness in the z-axis direction).

The first plate portion 61 and the second plate portion 62 constitute a lid portion 60 which covers at least a portion of the rotary member 51. The lid portion 60 is in a T-shape. In the following description, a surface of the lid portion 60 facing the rotary member 51 is a back surface 60*b* and an opposite surface is a front surface 60*a*.

The tool insertion hole 61*a* for inserting the tool T used for rotationally operating the rotary member 51 is formed on the first plate portion 61 at the middle portion in a width direction thereof (a direction orthogonal to the longitudinal direction). The tool insertion hole 61*a* penetrates the first plate portion 61 in the thickness direction. Meanwhile, a columnar protruding portion 611 is provided on the back surface 60*b* of the first plate portion 61 so as to be aligned with the tool insertion hole 61*a* along the longitudinal direction. The protruding portion 611 is provided at a position where the rotation of the rotary member 51 is not inhibited when the tool insertion hole 61*a* is located at a position facing the tool receiving portion 511*a* of the rotary member 51.

A first elastic support 63, which extends parallel to the longitudinal direction of the first plate portion 61, is integrally formed with the first plate portion 61 on a widthwise side surface. In addition, a first locking portion 64 is integrally formed at a front end portion 63*b* of the first elastic support 63. A cross sectional area of the first elastic support 63 on a surface orthogonal to the extending direction thereof is set to a dimension which allows elastic deformation and the first locking portion 64 to be supported. The elasticity of the first elastic support 63 allows the first locking portion 64 to move in a direction orthogonal to the longitudinal direction of the first plate portion 61.

A locking piece 641 protruding in a thickness direction of the lid portion 60 is provided on a surface of the first locking portion 64 facing the rotary member 51. In addition, a folded-back portion 642 which is folded back toward a root portion 63*a* of the first elastic support 63 so as to be in parallel to the first elastic support 63 is provided on the first locking portion 64. An inclined surface 642*a*, which is inclined with respect to the longitudinal direction of the first plate portion 61, i.e., with respect to the direction of fitting the male housing 21 to the female housing 22 so as to face the first plate portion 61, is formed on the folded-back portion 642.

At a longitudinal end of the first plate portion 61 opposite to the second plate portion 62, a second locking portion 66 is provided via a second elastic support 65 which extends along the longitudinal direction of the first plate portion 61. The second elastic support 65 and the second locking portion 66 are integrally formed with the first plate portion 61. A cross sectional area of the second elastic support 65 on a surface orthogonal to the extending direction thereof is set to a dimension which allows elastic deformation and the second locking portion 66 to be supported. A locking piece 661 protruding in a width direction of the first plate portion 61 is formed on the second locking portion 66.

The supported portion 67 to be supported by the support protrusion 211*e* (shown in FIGS. 5A and 5B) formed on the first element 211 of the male housing 21 is formed on the back surface 60*b* side of the second elastic support 65 and the second locking portion 66. The supported portion 67 integrally includes a bottom plate 67*a* facing the first plate portion 61 and a pair of side plates 67*b* which face each other in a width direction of the first plate portion 61. Also, the supported portion 67 is formed so that the support protrusion 211*e* can be housed in a space 67*c* defined by the first plate portion 61, the bottom plate 67*a* and the pair of side plates 67*b*.

A first arm 68 is provided at an end portion of the second plate portion 62 in the extending direction thereof and a second arm 69 is provided at another end portion in the same extending direction. The first arm 68 and the second arm 69 are provided so as to protrude from both edges of the second plate portion 62 toward the back surface 60*b* side. In addition, the first arm 68 and the second arm 69 are provided so as to sandwich the lid portion 60 therebetween in a direction orthogonal to the direction of fitting the male housing 21 to the female housing 22.

An engaging protrusion 681 protruding toward the second arm 69 is formed at the front end portion of the first arm 68. In addition, an engaging protrusion 691 protruding toward the first arm 68 is formed at the front end portion of the second arm 69. The engaging protrusions 681 and 691 are each engaged with the guide grooves 211*i* and 211*j* (shown in FIG. 5A) of the first element 211 of the male housing 21. That is, the first arm 68 and the second arm 69 are shown as an example of a pair of engaging protrusions in the invention. This configuration allows the lid member 6 to be guided by the guide grooves 211*i* and 211*j* and to slide along the direction of fitting the male housing 21 to the female housing 22 within a range corresponding to the length of the guide grooves 211*i* and 211*j*.

Figure 7A:
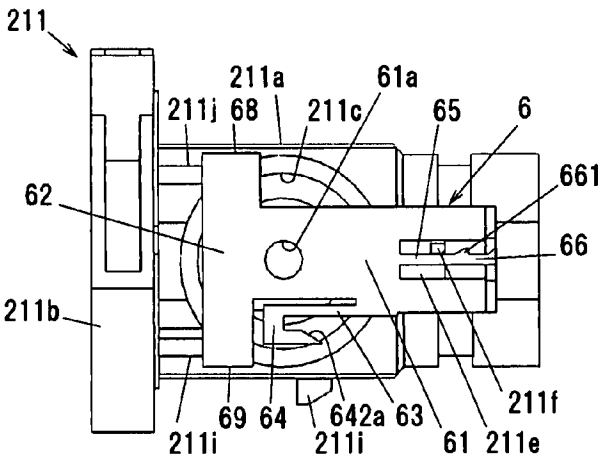
Figure 7B:
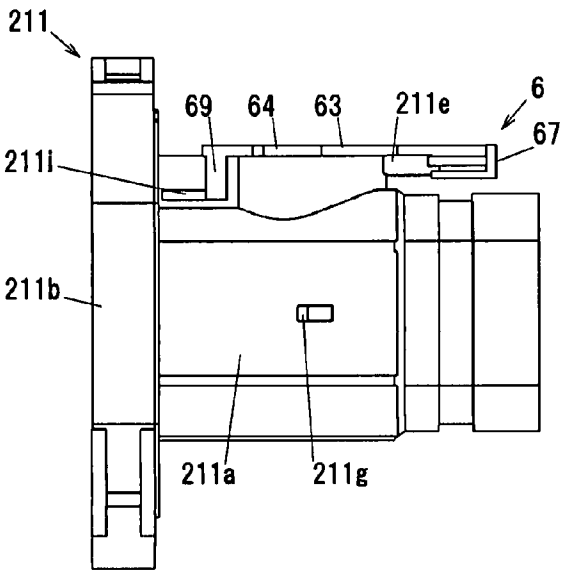
Figure 7C:
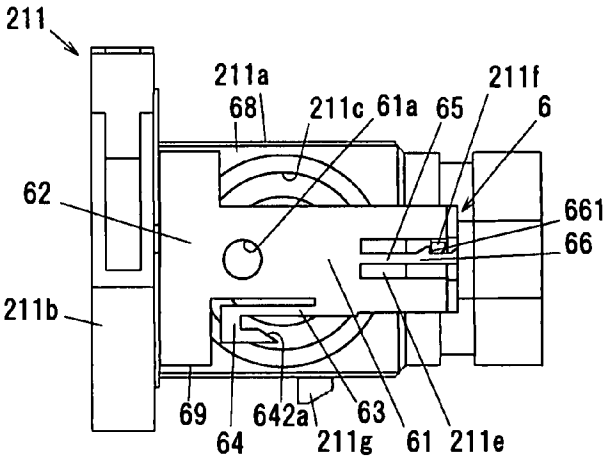
Figure 7D:
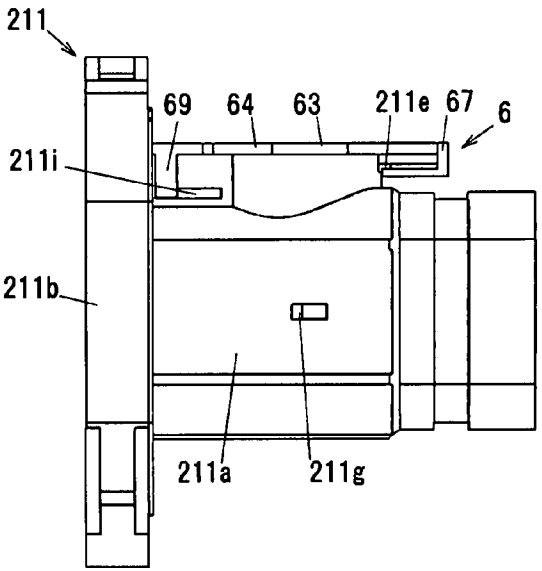

FIGS. 7A to 7D show a state that the first element 211 of the male housing 21 is assembled with the lid member 6, wherein FIG. 7A is a front view showing a state that the lid member 6 is located at a first position which is farthest from the flange portion 211*b* of the first element 211, FIG. 7B is a side view of the state shown in FIG. 7A, FIG. 7C is a front view showing a state that the lid member 6 is located at a second position which is closest to the flange portion 211*b* of the first element 211 and FIG. 7D is a side view of the state shown in FIG. 7C.

At the first position shown in FIGS. 7A and 7B, the tool insertion hole 61*a* of the lid member 6 is located at the center of the holding hole 211*c*, the supported portion 67 of the lid member 6 houses only the front end portion of the support protrusion 211*e* and the locking piece 661 of the second locking portion 66 is not locked to the locking protrusion 211*f*.

On the other hand, at the second position shown in FIGS. 7C and 7D, the tool insertion hole 61*a* of the lid member 6 is offset from the center of the holding hole 211*c*, the supported portion 67 of the lid member 6 houses substantially the entire support protrusion 211*e* and the locking piece 661 of the second locking portion 66 is locked to the locking protrusion 211*f*. By locking the second locking portion 66, the lid member 6 is locked to the first element 211 of the male housing 21 at the second position and the movement of the lid member 6 from the second position to the first position is restricted.

First Element 221 of Female Housing 22

Figure 8C:
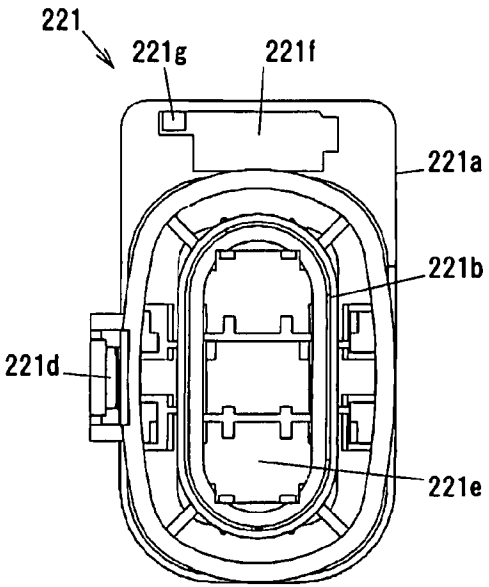
Figure 8B:
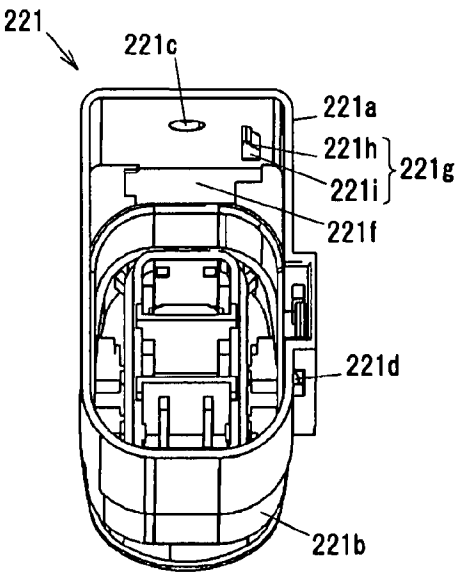
Figure 8A:
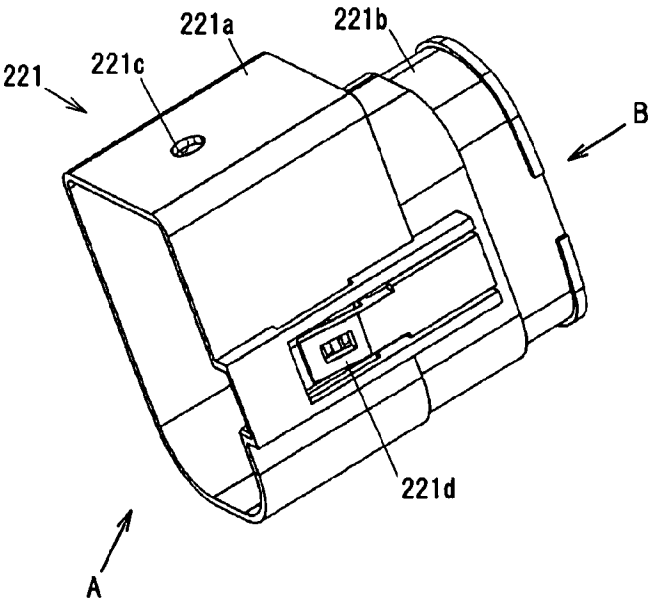

FIGS. 8A to 8C show a structure of the first element 221 of the female housing 22, wherein FIG. 8A is a perspective view, FIG. 8B is a view along an arrow A in FIG. 8A and FIG. 8C is a view along an arrow B in FIG. 8A.

As shown in FIGS. 8B and 8C, an opening 221*f* is formed on the first element 221 so that the supported portion 67 is inserted thereinto when the lid member 6 is located at the first position.

In addition, the first element 221 has a protrusion 221*g* provided inside the cylinder portion 211*a*. The protrusion 221*g* is integrally formed with the cylinder portion 211*a* at a position being offset from the through-hole 221*c* formed on the cylinder portion 211*a* in a direction orthogonal to the direction of fitting the male housing 21 to the female housing 22.

In addition, the protrusion 221*g* is formed so as to extend along the direction of fitting the male housing 21 to the female housing 22 and is composed of a front end portion 221*h* located on the side close to the flange portion 211*b* of the male connector 11 when the male housing 21 is fitted to the female housing 22 and a root portion 221*i* located on the opening 221*f* side. The width in a direction orthogonal to the direction of fitting the male housing 21 to the female housing 22 is smaller in the front end portion 221*h* than in the root portion 221*i*.

The edge of the second locking portion 66 of the lid member 6 can be seen through the opening 221*f* of the first element 221. When the lid member 6 is located at the second position, a worker can manipulate the second locking portion 66 of the lid member 6 through the opening 221*f* of the first element 221 to unlock from the locking protrusion 211*f* of the male housing 21. When the second locking portion 66 is unlocked from the locking protrusion 211*f* of the male housing 21, the lid member 6 can move from the second position to the first position.

That is, the locked state of the second locking portion 66 of the lid member 6 to the locking protrusion 211*f* of the male housing 21 can be released from the outside of the female housing 22, and the lid member 6 can be moved from the second position to the first position when the second locking portion 66 is unlocked from the locking protrusion 211*f* of the male housing 21. An operation for unlocking the second locking portion 66 can be carried out by, e.g., inserting a tool such as slotted screwdriver into the female housing 22 through the opening 221*f* and moving the locking piece 661 in a direction of unlocking from the locking protrusion 211*f*.

Mechanisms of Connector System 10

In addition to the pressing mechanism 5, the connector system 10 is provided with a rotation inhibiting mechanism 7 which can inhibit rotation of the rotary member 51 in a direction of generating a pressing force in a non-fitted state of the male housing 21 and the female housing 22, a rotation-inhibition release mechanism 8 configured such that inhibition of the rotation of the rotary member 51 by the rotation inhibiting mechanism 7 is released by fitting the male housing 21 into the female housing 22 to render the rotary member 51 rotatable, and a rotating-operation prevention mechanism 9 for preventing the rotational operation of the rotary member 51 in a state that the pressing mechanism 5 is generating a pressing force. Note that, inhibition of rotation here means to restrict the rotation unless an excessive force causing breakage or deformation of a member constituting the connector system 10 is applied.

Specific configuration examples of the pressing mechanism 5, the rotation inhibiting mechanism 7, the rotation-inhibition release mechanism 8 and the rotating-operation prevention mechanism 9 will be described below.

Pressing Mechanism 5

In the pressing mechanism 5, a pressing force to press, in the lamination direction, the laminated structure composed of the male connecting terminals 311 to 313, the female connecting terminals 321 to 323 and the first to fourth insulating members 41 to 44 is generated by the rotation of the rotary member 51 in the fitted state of the male housing 21 and the female housing 22.

In addition, as shown in FIG. 1B, the pressing mechanism 5 is composed of the rotary member 51, the cam ring 52 moving back and forth along the rotation axis of the rotary member 51 due to a camming action caused by the rotation of the rotary member 51, the coil spring 53 as an elastic member in contact with the cam ring 52 at one end and the output member 54 in contact with another end of the coil spring 53 to output the pressing force.

The rotary member 51 is a bottomed cylinder formed of metal such as aluminum which integrally includes a bottom portion 511 and a cylindrical portion 512. An annular support member 214 fixed to the holding hole 211*c* retains and supports the rotary member 51. It is possible to use, e.g., a snap ring as the annular support member 214.

A sealing member 237 for sealing between the cylindrical portion 512 and the holding hole 211*c* is arranged on the outer peripheral surface of the cylindrical portion 512. In addition, the tool receiving portion 511*a* for receiving a tip of the tool T (shown in FIG. 2B) used for turning the rotary member 51 is formed on the bottom portion 511 at the rotational center of the rotary member 51. In the present embodiment, the tool receiving portion 511*a* is a star-shaped recess. Accordingly, the tip of the tool T matching the shape of the tool receiving portion 511*a* is fitted to the tool receiving portion 511*a*, the tool T is then turned, and it is thus possible to turn the rotary member 51.

The cam ring 52 is a bottomed cylinder formed of metal such as aluminum which integrally includes a bottom portion 521 and a cylindrical portion 522. As for the cam ring 52, a portion of the cylindrical portion 522 and the bottom portion 521 are housed in the cylindrical portion 512 of the rotary member 51. The cylindrical portion 512 of the cam ring 52 houses an end portion of the coil spring 53.

The output member 54 is held by the support 212*a* of the second element 212 so as to be translatable within a predetermined range in the lamination direction of the laminated structure (the z-axis direction in FIG. 1B).

Figure 9A:
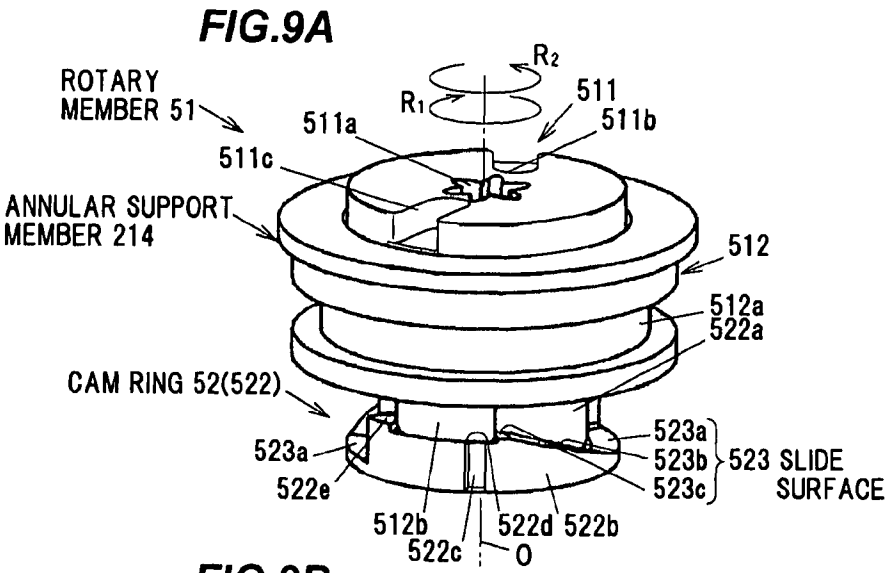
Figure 9B:
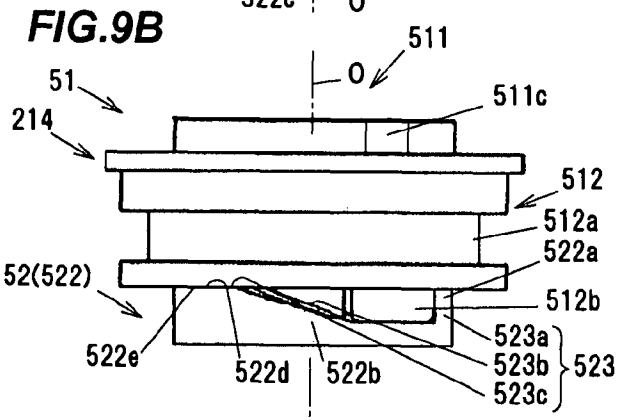
Figure 9C:
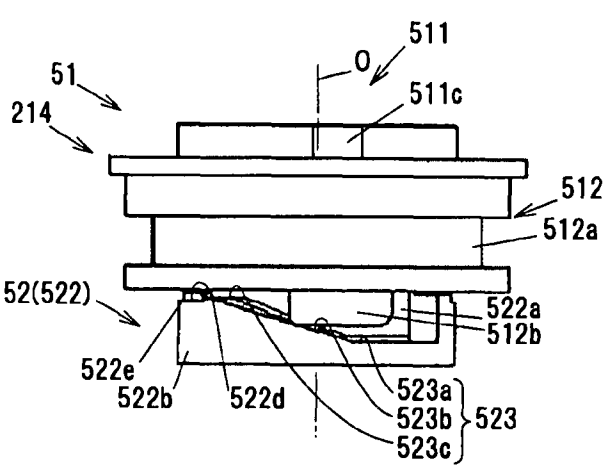
Figure 9D:
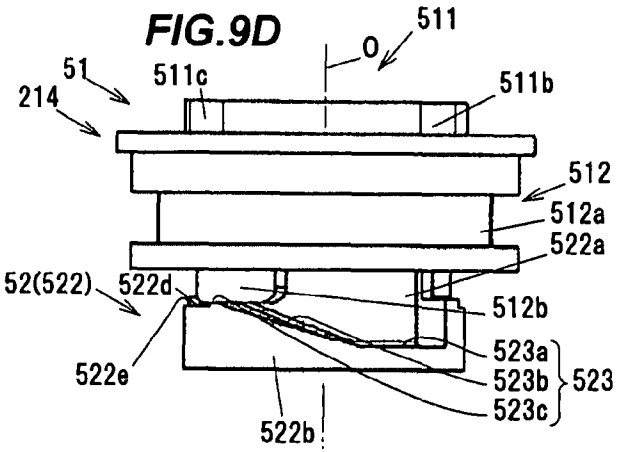

FIGS. 9A to 9D show structures and movement of the rotary member 51 and the cam ring 52, wherein FIG. 9A is a perspective view showing the rotary member 51 and the cam ring 52 and FIGS. 9B to 9D are side views showing the operation thereof.

As shown in FIG. 9A, the rotary member 51 has the bottom portion 511 of the columnar shape having the tool receiving portion 511*a* formed in a region including the rotation axis O and the cylindrical portion 512 formed to have a larger diameter than the bottom portion 511, and is configured that a level difference between the bottom portion 511 and the cylindrical portion 512 is in sliding contact with the annular support member 214 fixed to the holding hole 211*c* (shown in FIG. 1B).

A first recessed portion 511*b* and a second recessed portion 511*c* are formed on the bottom portion 511. The first recessed portion 511*b* and the second recessed portion 511*c* are formed to open outwardly in a radial direction of the bottom portion 511 and to extend from the opening toward the tool receiving portion 511*a*.

An annular recess 512*a* for holding the sealing member 237 (shown in FIG. 1B) is formed on the cylindrical portion 512. In addition, a sliding protrusion 512*b* protruding in a direction parallel to the rotation axis O is formed at an end portion of the cylindrical portion 512 opposite to the bottom portion 511. Note that, although plural (two in the present embodiment) sliding protrusions 512*b* are formed at equal intervals in a circumferential direction of the cylindrical portion 512, only one of the sliding protrusions 512*b* is shown in the FIG. 9A.

The cam ring 52 is assembled with the rotary member 51 so as to be relatively movable along the rotation axis O, and is biased toward the bottom portion 511 of the rotary member 51 by the coil spring 53 (shown in FIG. 1B).

The cylindrical portion 522 of the cam ring 52 has a small diameter portion 522*a* and a large diameter portion 522*b*. A slide groove 522*c* extending along the axial direction of the cylindrical portion 522 is formed on the outer peripheral surface of the large diameter portion 522*b*. The slide groove 522*c* is slidably engaged with the protrusion 211*d* (shown in FIGS. 1B and 5A) and stops rotation of the cam ring 52 with respect to the male housing 21. In other words, the rotation of the cam ring 52 with respect to the male housing 21 is restricted.

A slide surface 523 on which the sliding protrusion 512*b* slides in accordance with the rotation of the rotary member 51 is formed between the small diameter portion 522*a* and the large diameter portion 522*b*. The slide surface 523 is composed of a first flat surface 523*a*, a second flat surface 523*c* parallel to the first flat surface 523*a* and an inclined surface 523*b* formed therebetween. Plural sets (two sets in the present embodiment) of the first flat surface 523*a*, the inclined surface 523*b* and the second flat surface 523*c* are formed so as to correspond to the plural sliding protrusions 512*b*.

The first flat surface 523*a* and the second flat surface 523*c* are formed to be parallel to a radial direction of the cylindrical portion 522, to be orthogonal to the axial direction of the cylindrical portion 522 and to face the end face of the cylindrical portion 512 of the rotary member 51. The first flat surface 523*a* is formed at a position farther from the rotary member 51 than the second flat surface 523*c*.

Meanwhile, the inclined surface 523*b* is formed to be parallel to the radial direction of the cylindrical portion 522, to be inclined with respect to the axial direction of the cylindrical portion 522 and to connect the first flat surface 523*a* to the second flat surface 523*c* at a certain inclination angle.

Furthermore, in the large diameter portion 522*b*, a recessed portion 522*d* depressed in the axial direction of the cylindrical portion 522 is formed on the second flat surface 523*c* at a position opposite to the inclined surface 523*b*. It is possible to fit the sliding protrusion 512*b* of the rotary member 51 to the recessed portion 522*d*. FIG. 9A shows the state that the sliding protrusion 512*b* is fitted to the recessed portion 522*d*.

In addition, a stopper 522*e* for restricting movement of the sliding protrusion 512*b* in one circumferential direction of the cylindrical portion 522 is formed at the edge of the recessed portion 522*d* opposite to the second flat surface 523*c*. A height of the stopper 522*e* from the bottom surface of the recessed portion 522*d* (a distance in an axial direction of the cylindrical portion 522) is set to higher than the height of the second flat surface 523*c* from the bottom surface of the recessed portion 522*d*.

FIG. 9B shows the state that the sliding protrusion 512*b* of the rotary member 51 is located at a position in contact with the first flat surface 523*a* of the cam ring 52. In the following description, this state is called an initial state.

When the rotary member 51 is rotated forward (in a direction indicated by an arrow $R_1$ in FIG. 9A) with respect to the cam ring 52 from the initial state, the sliding protrusion 512*b* of the rotary member 51 slides on the inclined surface 523*b* of the cam ring 52 as shown in FIG. 9C. In the following description, this state is called an intermediate state. In the intermediate state, the cam ring 52 is separated from the rotary member 51 along the rotation axis O in accordance with the rotation angle of the rotary member 51.

When the rotary member 51 is further rotated forward with respect to the cam ring 52, the sliding protrusion 512*b* of the rotary member 51 slides on the second flat surface 523*c* of the cam ring 52 as shown in FIG. 9D. In the following description, this state is called a termination state. In the termination state, the cam ring 52 does not move in the axial direction with respect to the rotary member 51 even if the rotary member 51 is rotated forward with respect to the cam ring 52.

When the rotary member 51 is further rotated forward with respect to the cam ring 52 from the termination state, the sliding protrusion 512*b* of the rotary member 51 is fitted to the recessed portion 522*d* as shown in FIG. 9A. In the following description, this state is called a completed state. In the completed state, the forward rotation of the rotary member 51 is restricted by the stopper 522*e*. In addition, even if a torque to rotate the rotary member 51 in a reverse direction (a direction indicated by an arrow $R_2$ in FIG. 9A) acts, the rotary member 51 does not rotate unless the torque is greater than a force required for the sliding protrusion 512*b* to climb over the level difference between the recessed portion 522*d* and the second flat surface 523*c*. This prevents inadvertent rotation of the rotary member 51 in the reverse direction.

As described above, the cam ring 52 moves along the rotation axis O in a direction separating from the rotary member 51 due to the forward rotation of the rotary member 51 and compresses the coil spring 53. At this time, the rotary member 51 slidably contacts with the annular support member 214 without moving in a direction of the rotation axis O.

The coil spring 53 presses the output member 54 by the restoring force thereof. Since the laminated structure composed of the male connecting terminals 311 to 313, the female connecting terminals 321 to 323 and the first to fourth insulating members 41 to 44 is interposed between the output member 54 and the raised portion 211*k* formed on the first element 211 of the male housing 21, the restoring force of the compressed coil spring 53 functions as a pressing force to press the laminated structure in the lamination direction. In the termination state shown in FIG. 9D and the completed state shown in FIG. 9A, the pressing force of the pressing mechanism 5 is greater than a pressing force by which stable connection between the male connecting terminals 311 to 313 and the female connecting terminals 321 to 323 is ensured even if subjected to, e.g., vibration of a vehicle.

Rotation Inhibiting Mechanism 7

Figure 10A:
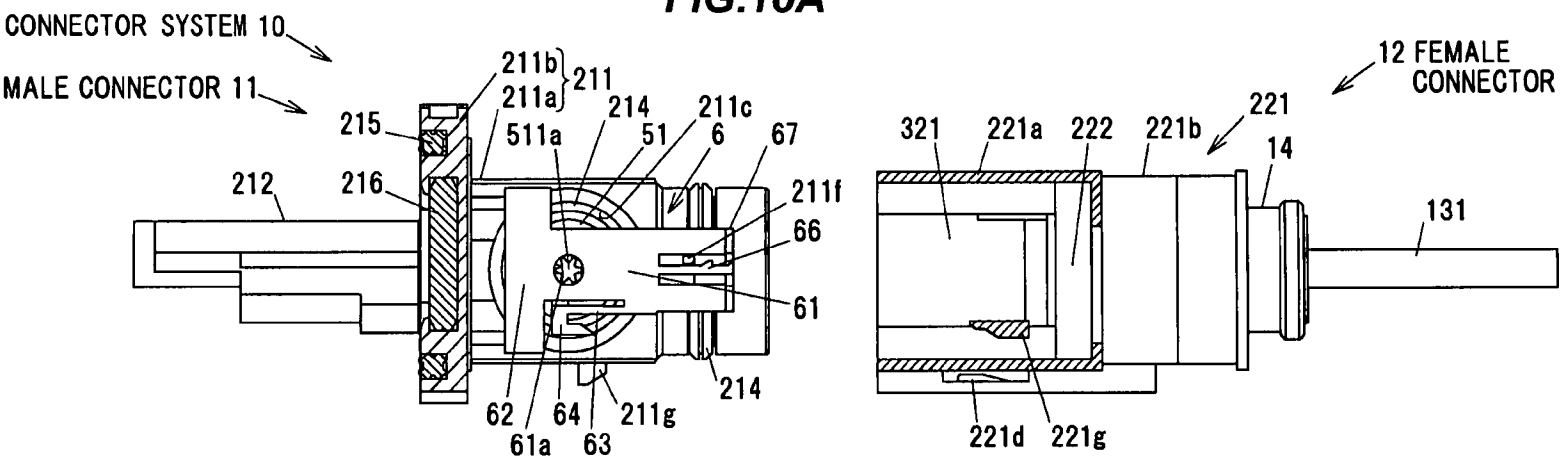
Figure 10B:
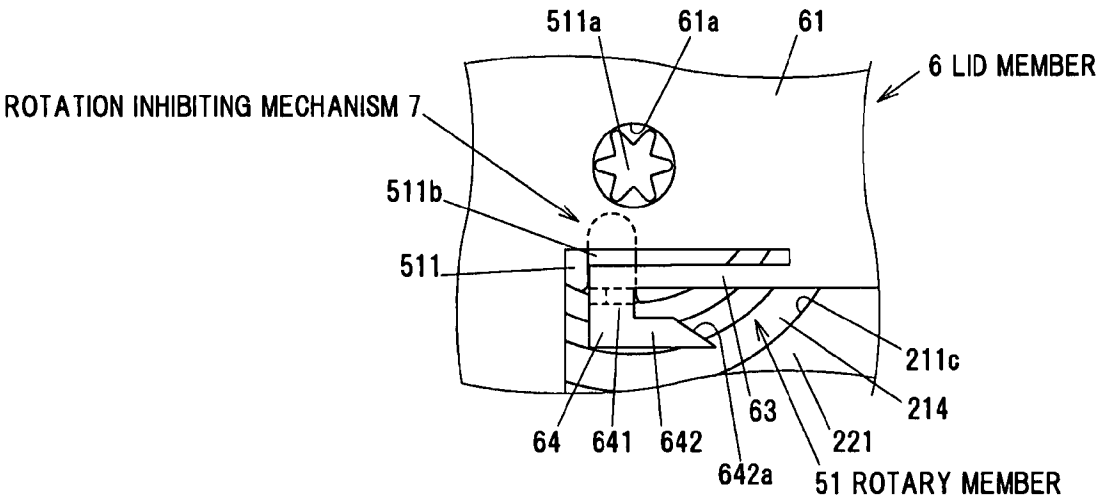

FIGS. 10A and 10B are explanatory diagrams illustrating a structure of the rotation inhibiting mechanism 7, wherein FIG. 10A is a front view showing the connector system 10 with the first element 221 of the female connector 12 partly broken away and FIG. 10B is a partial enlarged view of FIG. 10A.

As shown in FIG. 10A, the lid member 6 is located at the first position shown in FIGS. 7A and 7B in the non-fitted state which is before fitting the male housing 21 to the female housing 22. Meanwhile, the rotary member 51 is located at a first rotational position where the pressing mechanism 5 does not generate the pressing force. At the first rotational portion, an extending direction of the first recessed portion 511*b* of the rotary member 51 coincides with a direction orthogonal to the longitudinal direction of the first plate portion 61 of the lid member 6. The rotation inhibiting mechanism 7 inhibits the forward rotation (in a direction indicated by an arrow $R_1$ in FIG. 9A) of the rotary member 51 in this non-fitted state.

As enlarged and shown in FIG. 10B, the first elastic support 63 is in a natural shape in the non-fitted state of the male housing 21 and the female housing 22 without being elastically deformed by an external force. In this state, the locking piece 641 of the first locking portion 64 supported by the first elastic support 63 is engaged with the first recessed portion 511*b* formed on the bottom portion 511 of the rotary member 51 and thus inhibits the rotation of the rotary member 51.

That is, the rotation inhibiting mechanism 7 is composed of the first elastic support 63 of the lid member 6, the locking piece 641 of the first locking portion 64 supported by the first elastic support 63 and the bottom portion 511 of the rotary member 51 having the first recessed portion 511*b* formed thereon, and is configured to inhibit the rotation of the rotary member 51 by engagement of the first recessed portion 511*b* with the locking piece 641.

In addition, the engagement of the first recessed portion 511*b* with the locking piece 641 also inhibits longitudinal movement of the first plate portion 61 of the lid member 6.

Rotation-Inhibition Release Mechanism 8

Figure 11A:
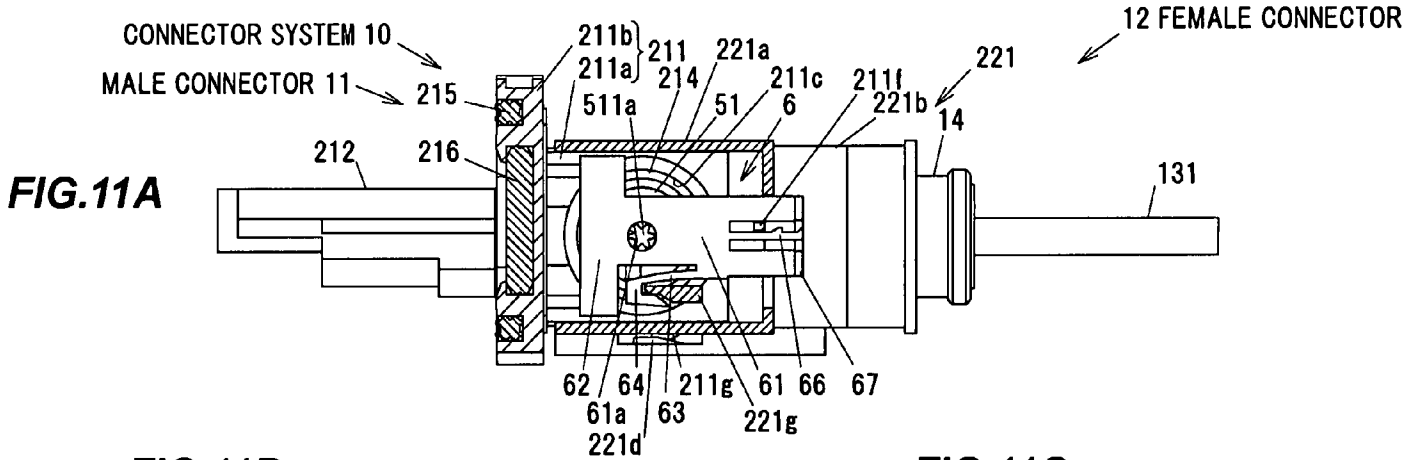
Figure 11B:
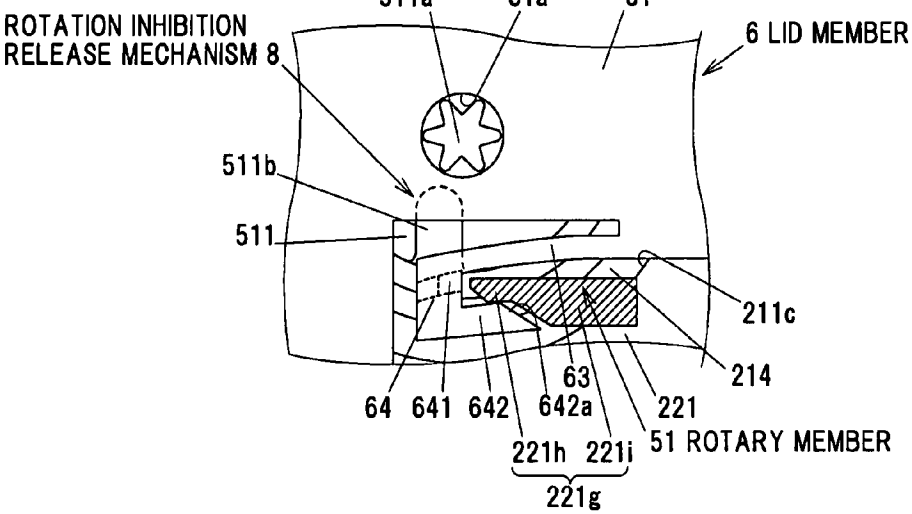
Figure 11C:
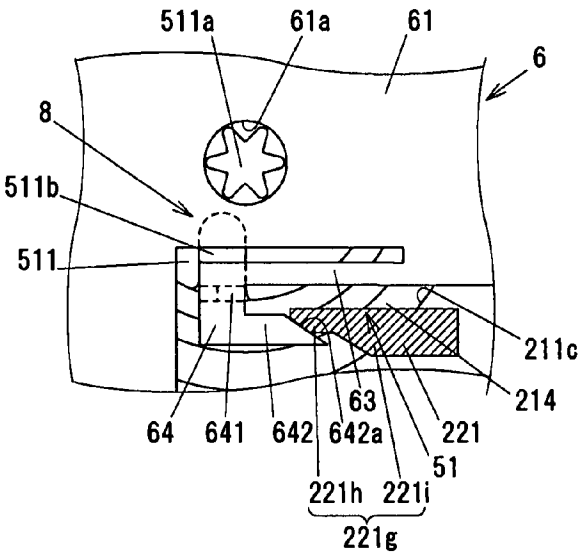

FIGS. 11A to 11C are explanatory diagrams illustrating a structure and a function of the rotation-inhibition release mechanism 8, wherein FIG. 11A is a front view showing the connector system 10 with the first element 221 of the female connector 12 partly broken away, FIG. 11B is a partial enlarged view of FIG. 11A and FIG. 11C is a state diagram illustrating that the protrusion 221*g* is in contact with the inclined surface 642*a* of the folded-back portion 642.

As shown in FIG. 11A, in the fitted state of the male housing 21 and the female housing 22, the protrusion 221*g* provided on the first element 221 of the female connector 12 comes into contact with the folded-back portion 642 of the lid member 6 and the first elastic support 63 is thereby elastically deformed. The elastic deformation of the first elastic support 63 moves the first locking portion 64 outward in the radial direction of the rotary member 51 and disengages the locking piece 641 from the first recessed portion 511*b*.

In detail, the process is carried out such that the protrusion 221*g* provided on the female housing 22 is relatively moved along the longitudinal direction of the first plate portion 61 of the lid member 6 so as to approach the folded-back portion 642 of the lid member 6 at the time of fitting the male housing 21 to the female housing 22.

When the front end portion 221*h* of the protrusion 221*g* comes into contact with the inclined surface 642*a* of the folded-back portion 642 due to the relative movement as shown in FIG. 11C, a force to displace the folded-back portion 642 outward in the radial direction of the rotary member 51 is generated by the contact of the inclined surface 642*a* with the front end portion 221*h*.

Since the folded-back portion 642 and the first locking portion 64 are integrally formed, the locking piece 641 of the first locking portion 64 is also displaced outward in the radial direction of the rotary member 51 in accordance with the displacement of the folded-back portion 642 and the locking piece 641 is thus disengaged from the first recessed portion 511*b* of the rotary member 51. In other words, the protrusion 221*g* displaces the locking piece 641 in a direction of releasing the locked state of the rotary member 51 at the first rotational position by the locking piece 641 at the time of fitting the male housing 21 to the female housing 22.

Accordingly, the rotation-inhibition release mechanism 8 is composed of the protrusion 221*g* provided on the female housing 22 and the folded-back portion 642 of the lid member 6 having the inclined surface 642*a* formed thereon, and is configured so that the first locking portion 64 is moved outward in the radial direction of the rotary member 51 by the contact of the protrusion 221*g* with the inclined surface 642*a* to disengage the locking piece 641 from the first recessed portion 511*b* and thereby to render the rotary member 51 rotatable.

Rotating-Operation Prevention Mechanism 9

Figure 12B:
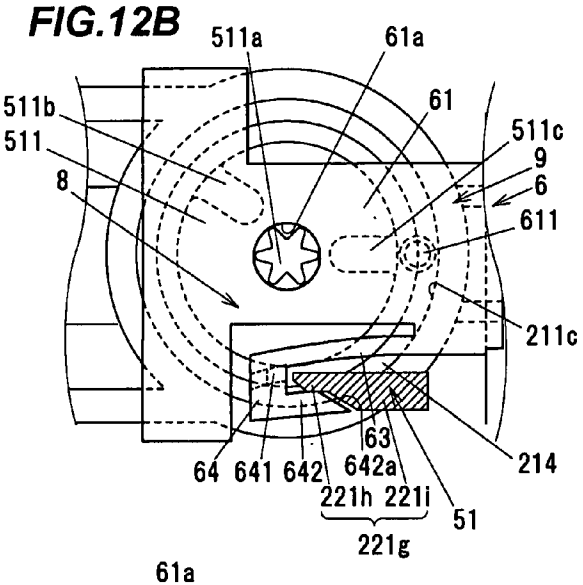
FIGS. 12A to 12C are explanatory diagrams illustrating a structure and a function of a rotating-operation prevention mechanism.
Figure 12A:
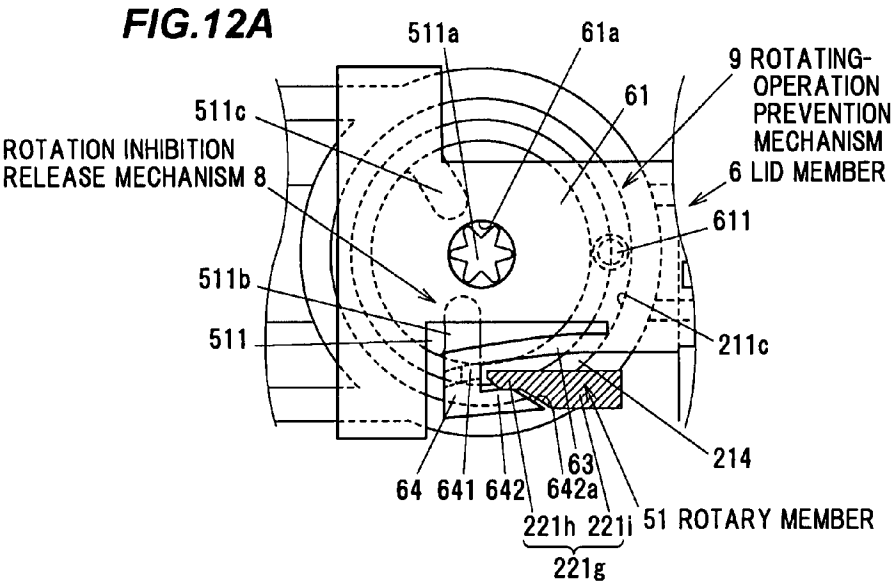
Figure 12C:
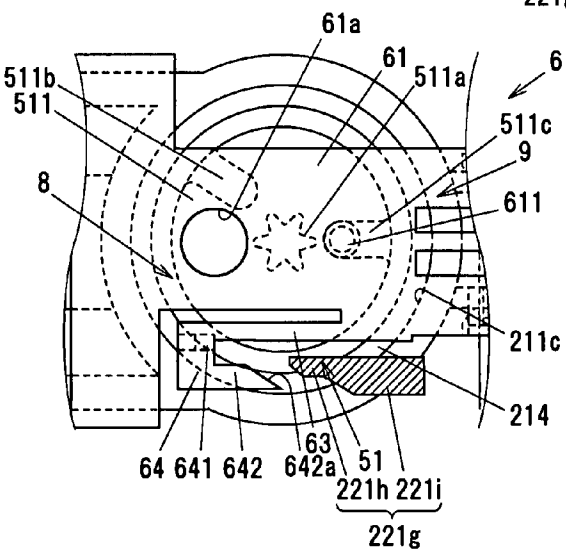

FIGS. 12A to 12C are explanatory diagrams illustrating a structure and a function of the rotating-operation prevention mechanism 9. An outline of each member covered by the lid member 6 is indicated by a dashed line in FIGS. 12A to 12C.

FIG. 12A shows a state that the rotary member 51 is rendered rotatable by the rotation-inhibition release mechanism 8 due to fitting of the male housing 21 to the female housing 22. In this state, the tool insertion hole 61*a* of the lid member 6 is located at a position corresponding to the tool receiving portion 511*a* of the rotary member 51 and it is possible to rotationally operate the rotary member 51 by the tool T which is inserted through the tool insertion hole 61*a*.

In addition, in this state, the protruding portion 611 provided on the first plate portion 61 of the lid member 6 is located outside of the bottom portion 511 of the rotary member 51. The lid member 6 is restricted from moving to the second position by interference between the protruding portion 611 and the bottom portion 511 of the rotary member 51.

FIG. 12B shows a state that the rotary member 51 is rotationally operated in a forward direction (the direction $R_1$ in FIG. 9A) from the first rotational position and the pressing mechanism 5 is generating the pressing force. In this state, the protruding portion 611 faces the radially outward opening of the second recessed portion 511*c* formed on the bottom portion 511 of the rotary member 51 and it is possible to move the lid member 6 to the second position. The position of the rotary member 51 in this state is defined as a second rotational position. When the rotary member 51 is located at the second rotational position, a cam mechanism composed of the rotary member 51 and the cam ring 52 is in the completed state shown in FIG. 9A.

In the present embodiment, a forward rotation angle from the first rotational position to the second rotational position is 120°. Therefore, when the rotary member 51 is turned to the second rotational position, i.e., when the rotation angle of the rotary member 51 from the first rotational position becomes a predetermined angle (120° in the present embodiment) and the pressing force of the pressing mechanism 5 reaches a predetermined value or more (in the present embodiment, a pressing force value which ensures stable connection between the male connecting terminals 311 to 313 and the female connecting terminals 321 to 323 in the laminated structure), the lid member 6 can move from the first position to the second position.

FIG. 12C shows a state that the lid member 6 is slid in the longitudinal direction of the first plate portion 61 to move to the second position shown in FIGS. 7C and 7D. This state corresponds to the state shown in FIGS. 4A and 4B.

In this state, the protruding portion 611 provided on the lid member 6 is engaged with the second recessed portion 511*c* formed on the rotary member 51 and the tool insertion hole 61*a* of the lid member 6 is located offset from the tool receiving portion 511*a* of the rotary member 51. As a result, it is not possible to rotationally operate the rotary member 51 by the tool T, and the rotational operation of the rotary member 51 is thereby restricted. In addition, the rotation of the rotary member 51 caused by, e.g., micro-vibration during vehicle running is inhibited by the engagement of the protruding portion 611 with the second recessed portion 511*c*. That is, the rotary member 51 is engaged with the lid member 6 by the movement of the lid member 6 from the first position to the second position, and the engagement therebetween inhibits the rotation of the rotary member 51.

As described above, the rotating-operation prevention mechanism 9 is composed of the lid member 6 and the rotary member 51, and is configured so that the tool receiving portion 511*a* is covered with the first plate portion 61 of the lid member 6 by moving the lid member 6 from the first position to the second position so as not to allow an operation from the outside. In addition, the protruding portion 611 is engaged with the second recessed portion 511*c* in accordance with the movement of the lid member 6, thereby preventing the rotation of the rotary member 51. Accordingly, the rotation of the rotary member 51 in a state that the lid member 6 is located at the second position is inhibited.

Functions and Effects of the Embodiment

The following functions and effects can be obtained in the embodiment.

(1) In the state before fitting the male housing 21 to the female housing 22, the rotation of the rotary member 51 is inhibited by the engagement of the locking piece 641 of the lid member 6 with the first recessed portion 511*b* of the rotary member 51. As a result, even if a worker tries to rotationally operate the rotary member 51, e.g., by mistake in procedure in the state that the male connector 11 is not coupled to the female connector 12, this operation is prevented. Accordingly, the pressing mechanism 5 is prevented from being operated before fitting the male housing 21 to the female housing 22 and it is thus possible to avoid the male connecting terminals 311 to 313 and the female connecting terminals 321 to 323 from scraping against each other in the pressed state at the time of coupling the male connector 11 to the female connector 12.

(2) The restriction of the rotary member 51 by the engagement of the locking piece 641 of the lid member 6 with the first recessed portion 511*b* of the rotary member 51 is released by fitting the male housing 21 to the female housing 22. In other words, since the rotary member 51 is rendered rotatable by fitting the male housing 21 to the female housing 22 without requiring a special operation to disengage the locking piece 641 from the first recessed portion 511*b*, workability is improved.

(3) Since the protrusion 221*g* of the female housing 22 for disengaging the locking piece 641 from the first recessed portion 511*b* is provided on the inner surface of the housing portion 221*a* of the female housing 22, the locking piece 641 is disengaged from the first recessed portion 511*b* in the state that the rotary member 51 is housed in the housing portion 221*a*. Therefore, the disengagement of the locking piece 641 from the first recessed portion 511*b* is carried out in the state that interference from the outside is prevented.

(4) Since the through-hole 221*c* of the female housing 22 is formed at the position corresponding to the tool receiving portion 511*a* of the rotary member 51 in the state that the male housing 21 is completely fitted to the female housing 22, it is not possible to rotationally operate the rotary member 51 without completely fitting the two housings 21 and 22. As a result, it is possible to prevent the rotary member 51 from being rotationally operated in the state that the male housing 21 is not completely fitted to the female housing 22, i.e., in the state that the locking piece 641 is not sufficiently disengaged from the first recessed portion 511*b*.

(5) The lid member 6 has the tool insertion hole 61*a* and the protruding portion 611 and is movable between the first position allowing the rotational operation of the rotary member 51 by the tool T inserted through the tool insertion hole 61*a* and the second position where the rotation of the rotary member 51 is inhibited by the protruding portion 611. Therefore, once the rotary member 51 is rotationally operated, further rotational operation of the rotary member 51 afterwards can be prevented by moving the lid member 6 to the second position. In addition, since the lid member 6 cannot be moved to the second position unless the rotary member 51 is located at the rotational position allowing the engagement of the second recessed portion 511*c* with the protruding portion 611, it is possible to prevent the lid member 6 from inhibiting the rotation in the state that the rotary member 51 is not sufficiently turned.

(6) Since the lid member 6 is formed of a resin material having elasticity and integrally includes the lid portion 60, the first elastic support 63 and the first locking portion 64 having the locking piece 641 formed thereon, it is possible to easily manufacture by, e.g., injection molding.

Although the embodiment of the invention have been described, the invention according to claims is not to be limited to the above-mentioned embodiment. Further, it should be noted that all combinations of the features described in the embodiment are not necessary to solve the problem of the invention.

For example, the application of the connector system 10 is not limited to installation to a current supply path for supplying an electric current to an electric motor as a drive source of a vehicle, and it is applicable for other purposes. In addition, the number of wires to be connected is not limited, neither.

In addition, although the case of holding the first to fourth insulating members 41 to 44 in the female housing 22 has been described in the present embodiment, the first to fourth insulating members 41 to 44 may be held in the male housing 21.

In addition, in the present embodiment, although the pressing mechanism 5 is configured such that the position of the rotary member 51 in the direction of the rotation axis O does not change even if the rotary member 51 is turned, it is not limited thereto and it may be configured such that the rotary member 51 is moved by the rotation thereof so as to approach the laminated structure composed of the male connecting terminals 311 to 313, the female connecting terminals 321 to 323 and the first to fourth insulating members 41 to 44.

In addition, although the lid member 6 is configured to cover a portion of the rotary member 51 in the present embodiment, the lid member 6 may be configured to cover the entire rotary member 51. Furthermore, in the present embodiment, although the connector system 10 is configured so that the housing portion 221*a* of the female housing 22 houses the cylindrical portion 221*a* of the first element 221 as a portion of the male housing 21, it is not limited thereto and the housing portion 221*a* of the female housing 22 may be configured to house the entire male housing 21.

What is claimed is:

1. A connector system, comprising:

a plurality of first connecting terminals;

a plurality of second connecting terminals each connected to the plurality of first connecting terminals;

a first housing for holding the plurality of first connecting terminals;

a second housing for holding the plurality of second connecting terminals;

a plurality of insulating members that are interposed between contact points of the plurality of first connecting terminals with the plurality of second connecting terminals when the first terminal housing is fitted to the second terminal housing;

a laminated structure that is formed by the plurality of first connecting terminals, the plurality of second connecting terminals and the plurality of insulating members when the first terminal housing is fitted to the second terminal housing;

a pressing mechanism comprising a rotary member rotatably supported on the first housing and configured to generate a pressing force to press the laminated structure composed of the plurality of first connecting terminals, the plurality of second connecting terminals and the plurality of insulating members in a lamination direction thereof;

a rotation inhibiting mechanism configured to inhibit a rotation of the rotary member in a direction of generating the pressing force when the first housing is not fitted to the second housing;

a rotation-inhibition release mechanism configured to release the inhibition of the rotation of the rotary member by the rotation inhibiting mechanism so as to allow the rotation of the rotary member when the first housing is fitted to the second housing;

wherein the rotation inhibiting mechanism comprises a locking piece on a side of the first housing and supported by an elastically deformable elastic support to lock the rotary member to inhibit a rotation thereof, wherein the rotation-inhibition release mechanism comprises a protrusion on a side of the second housing, and wherein the protrusion is configured to displace the locking piece in a direction of unlocking the rotary member from the locking piece when the first housing is fitted to the second housing.

2. The connector system according to claim 1, wherein the rotary member comprises a recessed portion configured to open outwardly in a radial direction thereof and is engaged with the locking piece at a rotational position where the pressing force is not generated, wherein the protrusion is provided inside a housing portion of the second housing and formed to house at least a portion of the first housing, and wherein the rotation-inhibition release mechanism is configured to displace the locking piece outwardly in a radial direction of the rotary member when the protrusion contacts with an inclined surface that is formed on the locking piece so as to be inclined with respect to a direction of fitting the first housing to the second housing.

3. The connector system according to claim 2, wherein the rotary member comprises, at a rotational center thereof, a tool receiving portion for receiving a tip of a tool used for turning the rotary member, and wherein the housing portion of the second hosing comprises a through-hole formed at a position corresponding to the tool receiving portion of the rotary member when the first housing is completely fitted to the second housing.

4. The connector system according to claim 3, further comprising:

a lid member slidably provided on the first housing so as to cover at least a portion of the rotary member, wherein the lid member comprises a tool insertion hole for inserting a tool used for turning the rotary member and a protruding portion protruding toward the rotary member, and wherein the lid member is configured to allow the tool insertion hole to move between a first position corresponding to the tool receiving portion of the rotary member and a second position allowing rotation of the rotary member to be inhibited by the protruding portion.

5. The connector system according to claim 4, wherein the lid member comprises a lid portion, the locking piece and the elastic support, the lid portion covering at least a portion of the rotary member and having the tool insertion hole and the protruding portion formed thereon, and wherein the lid portion, the locking piece and the elastic support are integrally formed.

* * * * *